US006505007B2

(12) United States Patent
Miura et al.

(10) Patent No.: US 6,505,007 B2
(45) Date of Patent: Jan. 7, 2003

(54) DEVELOPER REMAINING AMOUNT DETECTING METHOD, DEVELOPING DEVICE, PROCESS CARTRIDGE AND ELECTROPHOTOGRAPHIC IMAGE FORMING APPARATUS

(75) Inventors: Koji Miura, Mishima (JP); Jun Miyamoto, Mishima (JP); Tatsuya Suzuki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 09/796,457

(22) Filed: Mar. 2, 2001

(65) Prior Publication Data

US 2001/0026692 A1 Oct. 4, 2001

(30) Foreign Application Priority Data

Mar. 3, 2000 (JP) ..... 2000-058749
Feb. 9, 2001 (JP) ..... 2001-034289

(51) Int. Cl.[7] ..... G03G 15/08; G03G 15/10

(52) U.S. Cl. ..... 399/27; 399/64; 399/111; 399/119

(58) Field of Search ..... 222/DIG. 1; 399/27, 399/30, 58, 61, 62, 64, 111, 113, 119, 120, 254, 258

(56) References Cited

U.S. PATENT DOCUMENTS

| | | | | |
|---|---|---|---|---|
| 4,851,960 | A | 7/1989 | Nakamura et al. | 361/225 |
| 5,331,373 | A | 7/1994 | Nomura et al. | |
| 5,452,056 | A | 9/1995 | Nomura et al. | |
| 5,500,714 | A | 3/1996 | Yashiro et al. | |
| 5,585,889 | A | 12/1996 | Shishido et al. | |
| 5,617,579 | A | 4/1997 | Yashiro et al. | |
| 5,729,796 | A | 3/1998 | Miura et al. | 399/114 |
| 5,768,658 | A | 6/1998 | Watanabe et al. | 399/111 |
| 5,815,644 | A | 9/1998 | Nishiuwatoko et al. | 399/113 |
| 5,825,472 | A | 10/1998 | Araki et al. | |
| 5,870,655 | A | 2/1999 | Nishiuwatoko et al. | 399/111 |
| 5,893,006 | A | 4/1999 | Kanno et al. | 399/13 |
| 5,926,666 | A | 7/1999 | Miura et al. | 399/25 |
| 5,937,240 | A | 8/1999 | Kanno et al. | 399/111 |
| 5,946,531 | A | 8/1999 | Miura et al. | 399/111 |
| 5,950,047 | A | 9/1999 | Miyabe et al. | 399/111 |
| 6,002,896 | A | 12/1999 | Miyamoto et al. | 399/114 |
| 6,055,406 | A | 4/2000 | Kawai et al. | 399/360 |
| 6,061,538 | A | 5/2000 | Arimitsu et al. | 399/111 |
| 6,070,029 | A | 5/2000 | Nishuwatoko et al. | 399/111 |
| 6,167,219 | A | 12/2000 | Miyamoto et al. | 399/90 |
| 6,173,130 | B1 * | 1/2001 | Oguma | 399/27 |

FOREIGN PATENT DOCUMENTS

| | | |
|---|---|---|
| JP | 63-149669 | 6/1988 |

* cited by examiner

*Primary Examiner*—Hoang Ngo
(74) *Attorney, Agent, or Firm*—Fitzpatrick, Cella, Harper & Scinto

(57) ABSTRACT

A method of detecting a developer remaining amount for successively detecting the remaining amount of a developer used for developing an electrostatic latent image formed on an electrophotographic photosensitive member, the method including successively detecting the remaining amount of developer based on a period of time for which a light is blocked by a developer carried by a developer carrying member, wherein the developer is carried by the developer carrying member to a position in which the developer blocks the light that has entered a developer containing portion from a first light transmission opening of said a developer containing portion for containing the developer when the light transmitted from the first light transmission opening to an inside of the developer containing portion is transmitted from a second light transmission opening of the developer containing portion to an outside of the developer containing portion.

41 Claims, 13 Drawing Sheets

DEVELOPER REMAINING AMOUNT DETECTING METHOD, DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to a developer remaining amount detecting method, a developing device, a process cartridge and an electrophotographic image forming apparatus.

In the present specification, the process cartridge integrates charging means, developing means or cleaning means with an electrophotographic photosensitive member into a cartridge, and the cartridge is detachably mountable on an image forming apparatus main body. Also, the process cartridge integrates at least one of the charging means, the developing means and the cleaning means with the electrophotographic photosensitive member into a cartridge, and the cartridge is detachably mountable on the image forming apparatus main body. Further, the process cartridge integrates at least the developing means with the electrophotographic photosensitive member into a cartridge, and the cartridge is detachably mountable on the image forming apparatus main body.

Also, the developing device includes the developing means and a developer containing portion and develops an electrostatic latent image formed on the electrophotographic photosensitive member with a developer to visualize the image.

2. Related Background Art

Up to now, in an electrophotographic image forming apparatus using an electrophotographic image forming process, there has been applied a process-cartridge system, that is, the electrophotographic photosensitive member and process means that acts on the electrophotographic photosensitive member are integrated together into a cartridge, and the cartridge is detachably mountable on the image forming apparatus main body. According to the process cartridge system, since the maintenance of the apparatus can be conducted by a user per se instead of an attendant, the operability can be remarkably improved. For that reason, the process-cartridge system has been widely employed in the image forming apparatus.

In the above electrophotographic image forming apparatus, when the remaining amount of a developer (toner) contained in the developer containing portion of the developing means provided in the process cartridge is equal to or less than a predetermined amount, a user is notified of no toner and urged to exchange the process cartridge.

A conventional toner remaining amount detecting method of the light transmission type will be described with reference to FIG. 14. FIG. 14 is an explanatory diagram showing the toner remaining amount detecting structure of a developing device provided in a process cartridge.

In FIG. 14, reference numeral 104 denotes a developing device with a developer container 116 that contains toner T therein. An agitating member 112 is disposed within the developer container 116. The toner T is carried to a supply roller 111 with the rotation the agitating member 112. A lower light transmission window 114*a* and an upper light transmission window 114*b* for transmission of a light are fitted onto the developer container 116. The lower light transmission window 114*a* is disposed just below the rotating center of the agitating member 112, and the upper light transmission window 114*b* is disposed on a rear wall 116*a*. The lower light transmission window 114*a* and the upper light transmission window 114*b* form an optical path that transmits a detection light for detecting the remaining amount of developer. The agitating member 112 comes in contact with the lower light transmission window 114*a* and the upper light transmission window 114*b* every time the agitating member 112 rotates so as to wipe off the toner T stuck onto the inner sides of the respective light transmission windows 114*a* and 114*b*.

Light transmission is performed in such a manner that detection light L is emitted from a light emitting portion 115*a* fitted on the image forming apparatus main body (not shown), and the detection light L is transmitted by the lower light transmission window 114*a* and then transmitted by the upper light transmission window 114*b*. Thereafter, the detection light L is received by a light receiving portion 115*b* fitted onto the image forming apparatus main body.

The toner T within the developer container 116 is increasingly consumed in proportion to the image forming operation of the electrophotographic image forming apparatus, thereby coming to a state where the toner T remains only in a region portion of the supply roller 111 and the rotation region of the agitating member 112. When the toner T is further consumed such that the amount of toner T in the rotation region of the agitating member 112 is so reduced as to be substantially empty, the light is transmitted from the lower light transmission window 114*a* toward the upper light transmission window 114*b*, resulting in a state where the remaining amount of toner T is detectable.

In that state, how long the detection light L is received by the light receiving portion 115*b* during one revolution of the agitating member 112 is monitored. In this case, because the amount of toner T in the rotation region of the agitating member 112 within the developer container 116 is reduced, a period of time during which the detection light L is received by the light receiving portion 115*b* increases. Then, when the light receiving portion 116*b* detects the detection light L for a specific light receiving period of time (a set light receiving period of time for detecting no toner), the user is notified of the fact that the toner becomes almost empty in the developer container 116.

In the above developing device, when the amount of toner in the rotation region of the agitating member within the developer container is so reduced as to be nearly empty, the lower light transmission window and the upper light transmission window start to transmit the detection light for detecting the remaining amount of toner. This is because the detection light transmitted through the lower light transmission window disposed below the rotating center of the agitating member is prevented from being blocked with the toner since the amount of toner in the rotation region of the agitating member is so reduced as to be nearly empty. Accordingly, at the time when the user is informed of no toner, the toner hardly exists within the developer container.

The invention further develops the aforementioned conventional art.

SUMMARY OF THE INVENTION

The prevent invention has been made to further improve the above related art, and therefore an object of the present invention is to provide a developer amount detecting method, a developing device, a process cartridge and an electrophotographic image forming apparatus which are capable of successively detecting the remaining amount of developer.

Another object of the present invention is to provide a developer remaining amount detecting method, a developing device, a process cartridge and an electrophotographic image forming apparatus which are capable of detecting the remaining amount of developer from a stage where the developer remains in the developer containing portion.

Still another object of the present invention is to provide a developer amount detecting method, a developing device, a process cartridge and an electrophotographic image forming apparatus which are capable of successively detecting the remaining amount of developer by using a variation in light amount.

Yet still another object of the present invention is to provide a developer amount detecting method, a developing device, a process cartridge and an electrophotographic image forming apparatus which are capable of successively detecting the remaining amount of developer on the basis of a period of time during which a light is blocked with the developer carried by a developer carrying member.

Yet still another object of the present invention is to provide a developer remaining amount detecting method, a developing device, a process cartridge and an electrophotographic image forming apparatus which are capable of successively detecting the remaining amount of developer on the basis of a period of time during which the light is blocked with a developer carried by a developer carrying member, in which the developer is carried to a position in which the developer blocks the light that has entered a developer containing portion from a first light transmission opening of a developer containing portion for containing the developer with the developer carrying member when the light transmitted to the interior of the developer containing portion from the first light transmission opening is transmitted to the exterior from a second light transmission opening of the developer containing portion.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Now, a description will be provided in more detail of preferred embodiments of the present invention with reference to the accompanying drawings.

First Embodiment

Figure 1:
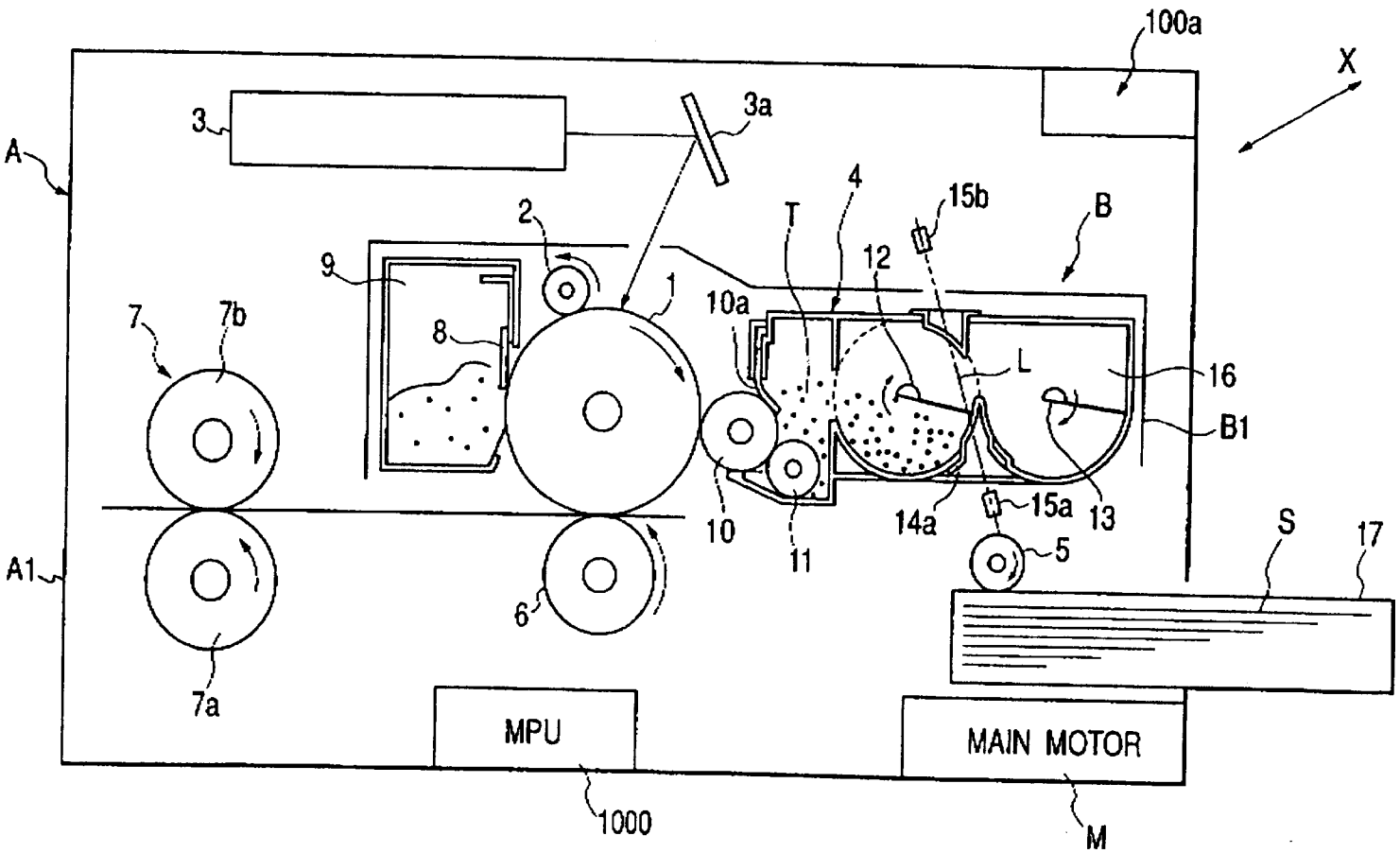
FIG. 1 is a vertical cross-sectional view showing a laser beam printer in accordance with an embodiment of the present invention.

First, the outline of the entire structure of an electrophotographic image forming apparatus will be described with reference to FIG. 1. FIG. 1 is a vertical cross-sectional view showing a laser beam printer which is one embodiment of the electrophotographic image forming apparatus that forms an image through an electrophotographic system.

Entire Structure

An electrophotographic image forming apparatus (hereinafter referred to as an image forming apparatus) A shown in FIG. 1 includes a drum-shaped electrophotographic photosensitive member (hereinafter referred to as a photosensitive drum 1). The photosensitive drum 1 is rotationally driven clockwise in FIG. 1 by a driving means (not shown but to be described later). In the periphery of the photosensitive drum 1 are disposed a charging device 2 that uniformly charges the surface of the photosensitive drum 1, an exposure device 3 that forms an electrostatic latent image on the photosensitive drum 1 to which a laser beam is projected on the basis of image information, a developing device 4 that sticks toner (developer) T onto the electrostatic latent image formed on the photosensitive drum 1 to develop the image as a toner image, a transfer device 6 that transfers the toner image formed on the photosensitive drum 1 to a recording medium (recording paper, OHP sheet, cloth, etc.) S, a cleaning container 9 that removes the non-transferred toner that remains on the surface of the photosensitive drum 1 after the toner image has been transferred to the recording medium, and so on. In addition, a feeding and conveying device 5 feeds the recording medium S to the transfer device 6 and conveys the recording medium 5, and a fixing device 7 fixes the toner image onto the recording medium S after the toner image has been transferred to the recording medium S.

The image forming apparatus A shown in FIG. 1 uniformly charges the surface of the photosensitive drum 1 that rotates at a constant speed by the charging device 2. Then, a laser beam irradiates the photosensitive drum 1 from the exposure device 3 in accordance with image information to form an electrostatic latent image on the photosensitive drum 1, and the electrostatic latent image is developed with the toner T by the developing device 4. Then, the developed image (toner image) formed on the photosensitive drum 1 is transferred by the transfer device 6 onto the recording medium S which is conveyed from a cassette 17 serving as a feed portion by the feeding and conveying device 5. Then, the recording medium S is conveyed to the fixing device 7, the toner image is fixed onto the recording medium S, and the recording medium S is discharged to the outside. After this transferring operation, the non-transferred toner that remains on the photosensitive drum 1 is scraped off by a cleaning blade 8 of the cleaning container 9 and collected within the cleaning container 9.

Process Cartridge

In this example, the photosensitive drum 1, the charging device 2, the developing device 4 and the cleaning container 9 are integrated together into a cartridge to form a process cartridge B. In more detail, the photosensitive drum 1, the charging device 2 serving as charging means, the developing device 4 serving as developing means and a cleaning container 9 serving as cleaning means are held by a cartridge frame B1 that constitutes a housing of the process cartridge B so as to be integrated together into a cartridge. The process cartridge B is detachably mounted on mounting means disposed in an image forming apparatus main body A1.

The cartridge mounting means is designed such that when an openable and closable member ( not shown) which is disposed on a top portion of the image forming apparatus main body A1 is opened with its axis as a center, a space of a cartridge mounting portion appears. Cartridge mounting guide members (not shown) are disposed at the right and left sides of the cartridge mounting portion. Guides consisting of a boss and a rib disposed on the outer side surfaces of the process cartridge B in its longitudinal direction (the axial direction of the photosensitive drum 1) are engaged with the mounting guide member so as to be guided, and the process cartridge B is mounted to and detached from the image forming apparatus main body A1 in a direction indicated by an arrow X.

Hereinafter, a description will be provided in more detail as to the structures of the respective members in the image forming apparatus A in the stated order of the photosensitive drum 1, the charging device 2, the exposure device 3, the developing device 4, the transfer device 6, the cleaning container 9, the feeding and conveying device 5 and the fixing device 7.

Photosensitive Drum

The photosensitive drum 1 is structured by coating an organic photoconductive layer (OPC photosensitive member) on the outer peripheral surface of an aluminum cylinder. The photosensitive drum 1 is rotatable and supported at both end portions in the longitudinal direction thereof by the cartridge frame B1 that constitutes the housing of the process cartridge B. A driving force is transmitted from a driving motor (not shown) at the image forming apparatus main body A1 side to one end portion of the photosensitive drum 1, to rotate the photosensitive drum 1 in a direction indicated by an arrow.

Charging Device

For example, the charging device 2 of a so-called contact charging system disclosed in Japanese Patent Application Laid-Open No. 63-149669 can be used. A charging member that charges the photosensitive drum 1 in contact therewith is an electrically conductive roller (hereinafter referred to as a charging roller) formed in the form of a roller. Then, the charging roller is abutted against the surface of the photosensitive drum 1, and a charge bias voltage is applied to the charging roller by a power supply (not shown) on the image forming apparatus main body A1 side, to thereby uniformly charge the surface of the photosensitive drum 1.

Exposure Device

The exposure device 3 includes a polygon mirror (not shown) and image light corresponding to an image signal irradiates the polygon mirror by a laser diode (not shown). The polygon mirror is rotated at a high speed by a scanner motor (not shown), and the reflected image light selectively exposes the surface of the photosensitive drum 1, which has been already charged, through an imaging lens (not shown), a reflecting mirror 3*a* and so on, to thereby form an electrostatic latent image.

Developing Device

The developing device 4 develops the electrostatic latent image on the photosensitive drum 1, and the developing roller 10 disposed in a toner container (developer containing portion) that contains the toner T therein is positioned opposite to the photosensitive drum 1 with a fine gap (about 300 $\mu$m). The development of the electrostatic latent image is conducted as follows: The toner T within the toner container (developer containing portion) 16 is sent to the supply roller 11 by the second developer carrying member 13 and the developer carrying member (first developer carrying member) 12. Then, the toner T is coated into a thin layer on the outer periphery of the developing roller 10 that is rotating by the supply roller 11 that is rotating and a toner regulating blade 10*a*, and charges are induced to the toner T (triboelectrification). A developing bias is applied between the developing roller 10 and the photosensitive drum 1 on which the electrostatic latent image has been formed, to thereby stick the toner onto the electrostatic latent image to develop the image as a toner image.

Transfer Device

The transfer device 6 is so designed as to transfer the toner image from the photosensitive drum 1 onto the recording medium S. In this embodiment, the transfer roller is used as the transfer device 6. Then, a transfer bias is applied to the transfer roller, to thereby transfer the toner image from the photosensitive drum 1 onto the recording medium S.

Cleaning Container

The cleaning container 9 is so designed as to scrape off and remove, by the cleaning blade 8, a so-called non-transferred toner that has remained on the surface of the photosensitive drum 1 without being transferred to the recording medium S, after the toner image developed on the photosensitive drum 1 by the developing device 4 has been transferred onto the recording medium S by the transfer device 6. The non-transferred toner which has been scraped off by the cleaning blade 8 is collected in the cleaning container 9.

Feeding and Conveying Device

The feeding and conveying device 5 is so designed as to feed the recording medium S to an image forming portion (between the photosensitive drum 1 and the transfer device 6) and is driven in accordance with the image forming operation to separate and feed the recording medium S within the cassette 17 sheet by sheet.

Fixing Device

The fixing device 7 is so designed as to fix the toner image that has been transferred to the recording medium S. The fixing device 7 includes a driving roller 7*a* and a fixing roller 7*b* having a built-in heater (not shown). The fixing device 7 applies heat and pressure to the recording medium S that passes through the fixing device 7. With this operation, the toner image is fixed onto the surface of the recording medium S. In addition, the recording medium S is discharged to the outside by a discharge device (not shown).

Figure 2:
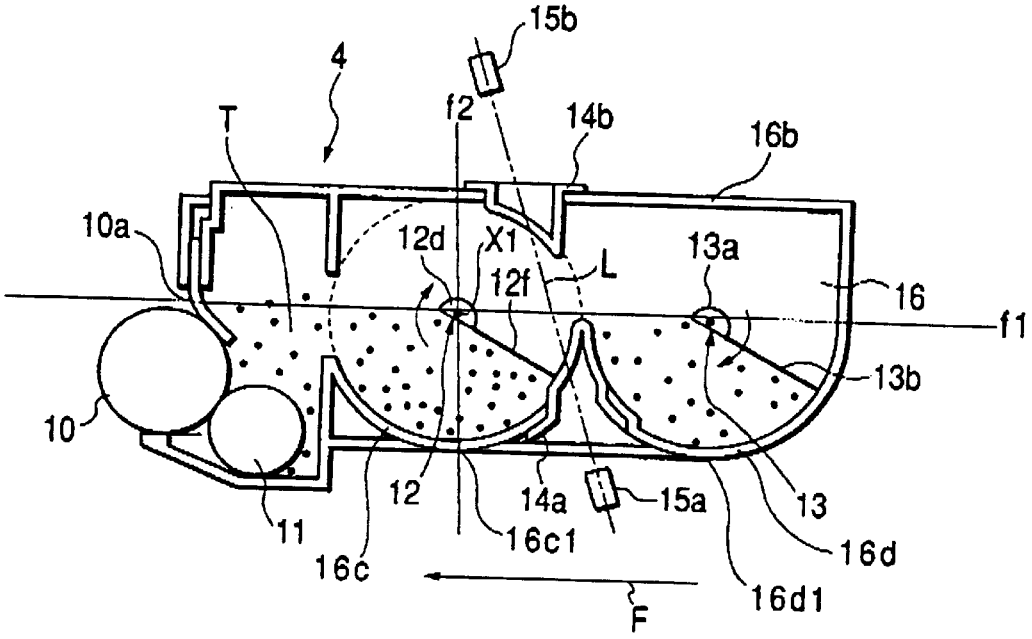
FIG. 2 is a vertical cross-sectional view showing a light-transmission-type, toner-remaining-amount detecting structure of a developing device provided in a process cartridge in accordance with a first embodiment of the present invention.

Description of the Light Transmission Type Toner Remaining Amount Detecting Structure The light-transmission-type, toner-remaining-amount detecting structure of the developing device will be described in more detail with reference to FIGS. 1 and 2. FIG. 2 is a vertical cross-sectional view showing the light-transmission-type, toner-remaining-amount detecting structure of the developing device.

The first developer carrying member 12 and the second developer carrying member 13 are disposed in parallel within the toner container 16 of the developing device 4 in the stated order from a side closer to the developing roller 10. The toner T is carried to the supply roller 11 with the rotation of the respective carrying members 12 and 13. The first and second carrying members 12 and 13 include shafts 12*d* and 13*a* as their rotating centers, respectively. Plate-shaped blades 12*f* and 13*b* are fixed onto the shafts 12*d* and 13*a*, respectively. Those blades 12*f* and 13*b* hold the toner T with the rotation of the shafts 12*d* and 13*a* and carry the toner T in the rotating directions of the shafts 12*d* and 13*a*. The blades 12*f* and 13*b* are made of a material that can wipe the toner T stuck onto the inner surface of those light transmission windows 14*a* and 14*b* when the blades 12*f* and 13*b* come in contact with the lower light transmission window 14*a* and the upper light transmission window 14*b* which will be described later, and does not damage the inner surface of the light transmission windows 14*a* and 14*b*.

In the toner container 16, there are disposed the lower light transmission window 14*a* that serves as a first light transmission opening and the upper light transmission window 14*b* that serves as a second light transmission opening, respectively. The lower light transmission window 14*a* is located at a position which is substantially in horizontal with the shaft 12*d* of the carrying member 12 in a state where the process cartridge B is mounted in the image forming apparatus main body A1. The upper light transmission window 14*b* is located at a position which is above the shaft 12*d* of the carrying member 12 in a state where the process cartridge B is mounted in the image forming apparatus main body A1. The lower light transmission window 14*a* and the upper light transmission window 14*b* form an optical path that transmits the detection light L for detecting the remaining amount of toner T. In more detail, the lower light transmission window 14*a* allows the detection light L to be transmitted from the exterior of the toner container 16 to the interior of the toner container 16, and the upper light transmission window 14*b* allows the detection light L that has been transmitted from the lower light transmission window 14*a* to the interior of the toner container 16 to be transmitted to the exterior of the toner container 16.

The carrying member 12 is designed in such a manner that the blade 12*f* serving as a carrying blade comes in contact with the lower light transmission window 14*a* and the upper light transmission window 14*b*, and the toner T stuck onto the inner surfaces of the respective light transmission windows 14*a* and 14*b* is wiped off by a distal end of the blade 12*f*, every time the carrying member 12 rotates clockwise.

The manner of transmitting the detection light L is that the detection light L is emitted from the light emitting element 15*a* fitted to the image forming apparatus main body A1, transmitted to the lower light transmission window 14*a* and then transmitted to the upper light transmission window 14*b*, and thereafter received by the light receiving element 15*b* fitted to the image forming apparatus main body A1.

Description of Toner Remaining Amount Detecting Method

Figure 3:
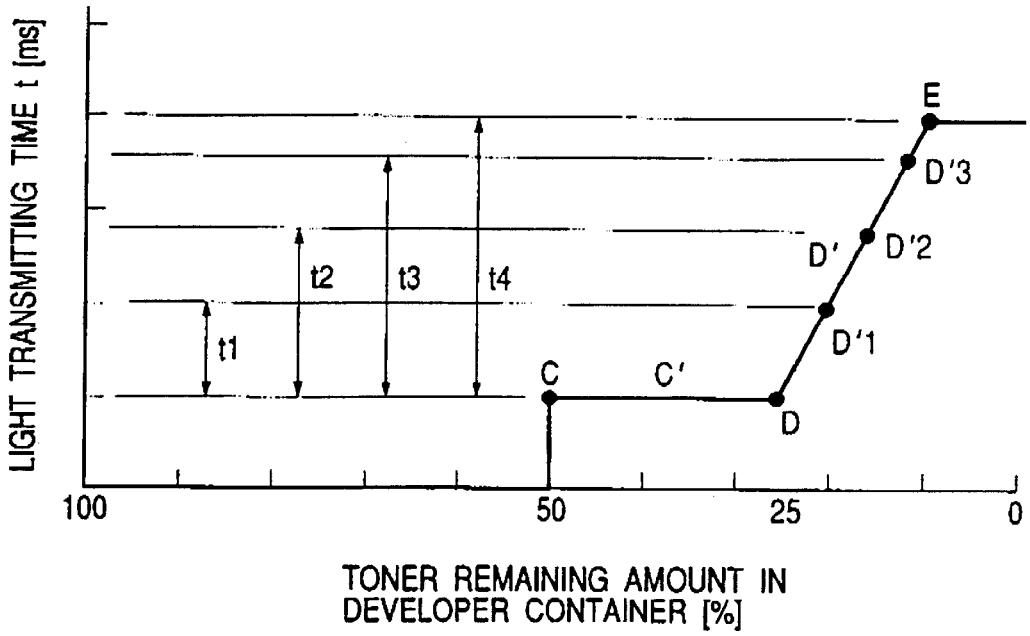
FIG. 3 is an explanatory diagram showing the relationship between the toner remaining amount within a toner container and the light transmitting time.
Figure 4A:
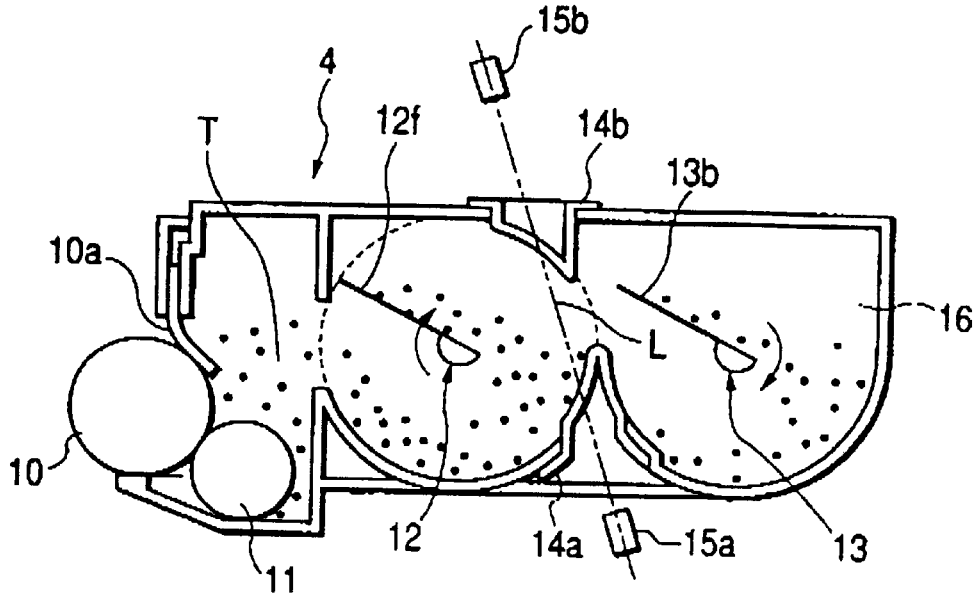
FIG. 4A is a cross-sectional view showing a developing device having a toner amount corresponding to a point C shown in FIG. 3.
Figure 4B:
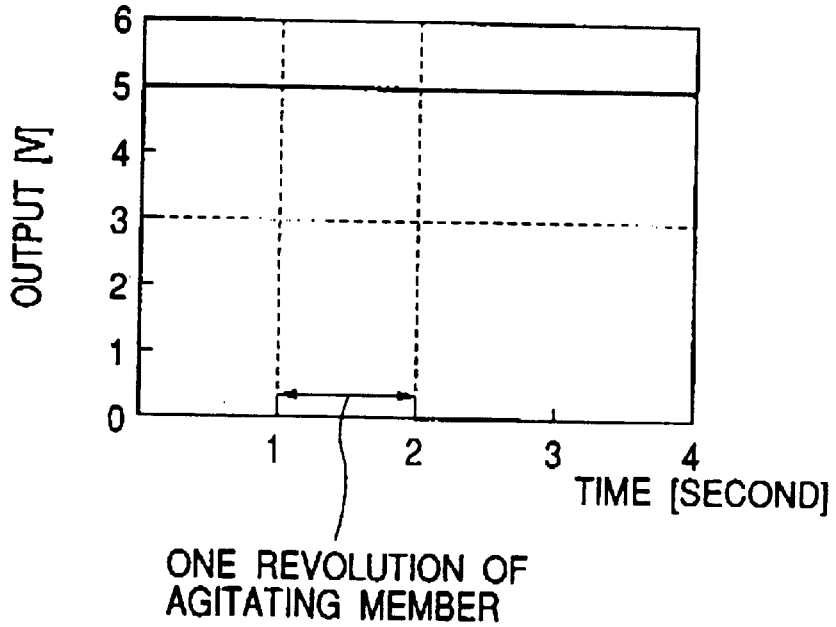
FIG. 4B is a graph showing the relationship between time and output.
Figure 5A:
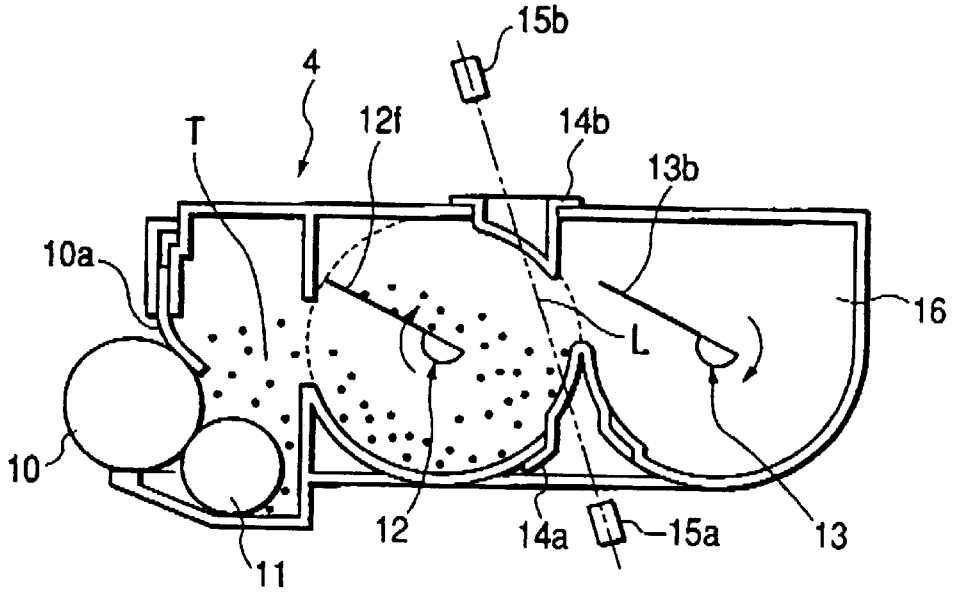
FIG. 5A is a cross-sectional view showing a developing device having a toner amount corresponding to a point D shown in FIG. 3.
Figure 5B:
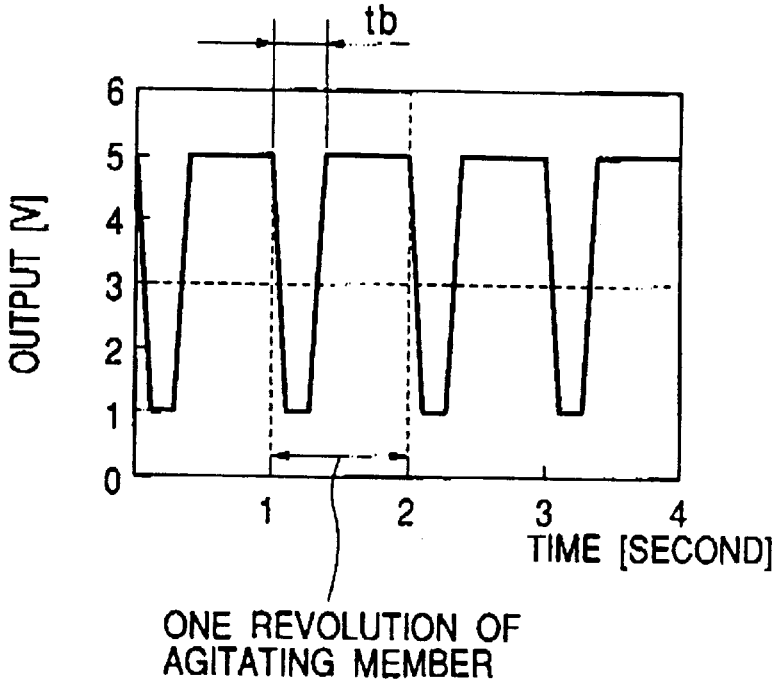
FIG. 5B is a graph showing the relationship between time and output.
Figure 6A:
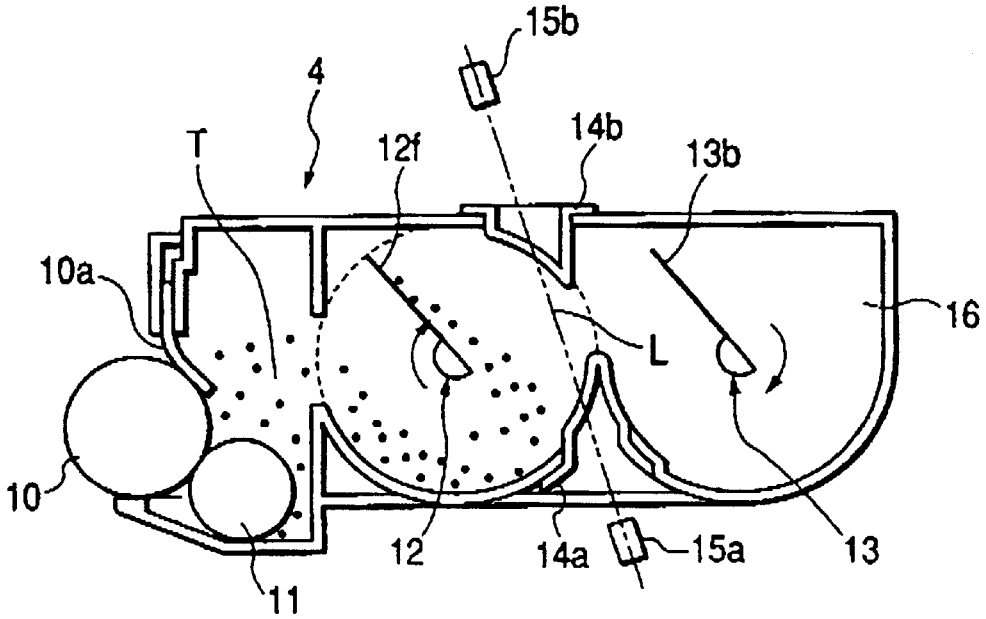
FIG. 6A is a cross-sectional view showing a developing device corresponding to a point E shown in FIG. 3.
Figure 6B:
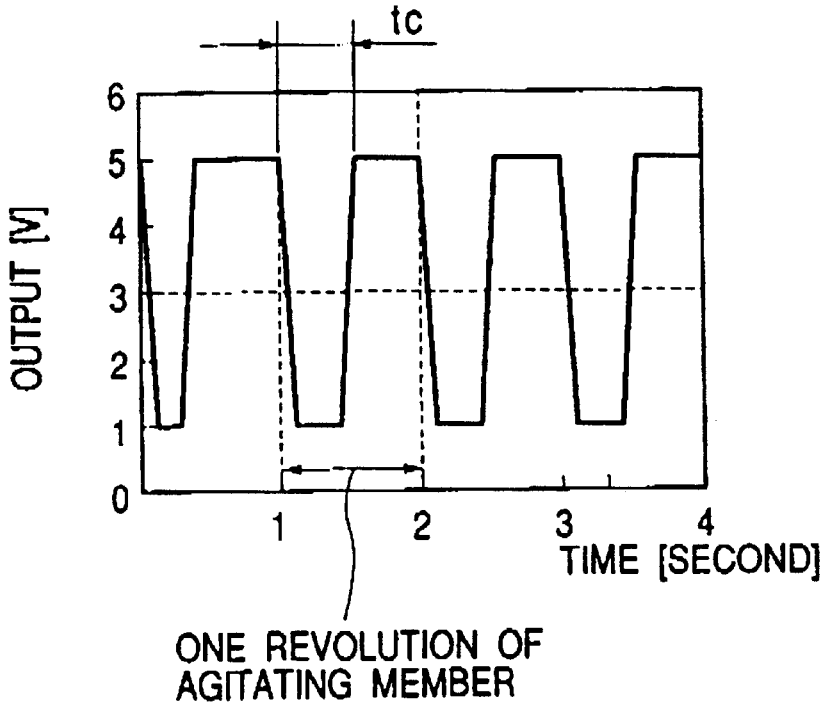
FIG. 6B is a graph showing the relationship between time and output.

A method of detecting the toner remaining amount in the light transmission manner will be described in more detail with reference to FIGS. 2 to 6B. FIG. 3 is an explanatory diagram showing the relationship between the toner remaining amount within a toner container and a light transmitting time. FIG. 4A is a cross-sectional view showing a developing device having a toner amount corresponding to a point C shown in FIG. 3, and FIG. 4B is a graph showing the relationship between time and output. FIG. 5A is a cross-sectional view showing a developing device having a toner amount corresponding to a point D shown in FIG. 3, and FIG. 5B is a graph showing the relationship between time and output. FIG. 6A is a cross-sectional view showing a developing device corresponding to a point E shown in FIG. 3, and FIG. 6B is a graph showing the relationship between time and output. It is assumed that in the process cartridge B which will be described below, the toner T is contained within the toner container 16 of the developing device 4 in a full state (100%) which extends the agitating member shafts 12*d* and 13*b* of the first and second agitating members 12 and 13.

When the toner T within the toner container 16 of the process cartridge B is increasingly consumed in proportion to the image forming operation of the image forming apparatus A, as shown in FIG. 2, the toner T remains in a lower half region of the rotating region of the carrying member 13, in the region portion of the supply roller 11 and in a half region of the rotating region of the carrying member 12. In this state, as will be described later, a light is transmitted from the lower light transmission window 14*a* to the upper light transmission window 14*b*, resulting in a state that the remaining amount of toner T is detectable.

In the above-described state where the toner T remains (refer to FIG. 2), the carrying member 12 holds the toner T by the blade 12*f* while the carrying member 12 rotates clockwise, and supplies the toner T to the region portion of the supply roller 11 after wiping off the inner surface of the lower light transmission window 14*a* by the distal end of the blade 12*f*. With this operation, a region where there exists no toner is formed in the vicinity of the lower light transmission window 14*a* after the blade 12*f* has passed there. The detection light L emitted from the light emitting element 15*a* is transmitted by the lower light transmission window 14*a* of the toner container 16, is then transmitted by the upper light transmission window 14*b* and received by the light receiving element 15*b* immediately after the no-toner region has been formed.

FIG. 3 shows the relationship between the light transmission time t during which the detection light L is received by the light receiving element 15*b* per one revolution of the carrying member 12 and the toner T that remains in the toner container 16. In FIG. 3, the time at which the detection light L is transmitted by the lower light transmission window 14*a* and the upper light-transmission window 14*b* is a point C. That is, at a point where the toner capacity (lifetime) within the toner container 16 is about half, the detection light L is transmitted by the lower light transmission window 14*a* and the upper light transmission window 14*b*. At this time, the light transmission signal is obtained by the light receiving element 15*b*, and the user can be informed that the remaining amount of toner T is half (about 50%) if the user is going to be informed of the remaining amount of toner T.

As shown in FIG. 4A, the carrying member 12 supplies the toner T to the supply roller 11 side after wiping off the inner surface of the lower light transmission window 14*a* by the distal end of the blade 12*f*. Then, the carrying member 12 supplies the toner T of the short amount to the supply roller 11 side and returns the remaining toner T as it is, and discharges the remaining toner T onto the lower light transmission window 14*a*. In this situation, the remaining toner T blocks the detection light L which is transmitted through the lower light transmission window 14*a*. Also, the carrying member 13 supplies the toner T to the rotating region of the carrying member 12 by the blade 13*b*, but if the toner T is sufficient in the rotating region of the carrying member 12, the carrying member 13 returns the toner T to the rotating region of the carrying member 13. Also, if the toner T is sufficient in the rotating region of the carrying member 12 to which the toner T is supplied, the toner T is discharged to the rotating region of the carrying member 13 by the blade 12*f*. Therefore, until the toner T becomes empty in the rotating region of the carrying member 13, the toner T is held to substantially the horizontal height of the shaft 12*d* of the carrying member 12 in the rotating region of the carrying member 12. Therefore, in the relationship between the light transmission time t and the remaining toner T shown in FIG. 3, the toner T within the toner container 16 is consumed in fact. However, because the amount of toner that blocks the detection light L in the rotating region of the carrying member 12 is held to substantially the horizontal height of the shaft 12*d*, a substantially horizontal light transmitting time is kept in the region of a line segment C' between the point C and the point D. That is, the light transmitting time in the region of the line segment C' becomes substantially equal to the light transmitting time at the point C.

In addition, when the consumption of the toner T continues, the toner T becomes empty in the rotating region of the carrying member 13 within the toner container 16, and the toner T remains only in the region portion of the supply roller 11 and in the lower half region of the rotating region of the carrying member 12 (refer to FIG. 5A). The relationship between the remaining amount of toner T within the toner container 16 and the light transmitting time t of the detection light L at that time becomes a point D in FIG. 3. At that point, since the toner T is not supplied from the carrying member 13 to the rotating region of the carrying member 12, the toner T remaining in the rotating region of the carrying member 12 is supplied to the supply roller 11 side. As a result, the toner T gradually is reduced from the rotating region of the carrying member 12. As a result, after the toner T is supplied to the supply roller 11 side by the short amount, the remaining amount of toner T still is reduced in the rotating region of the carrying member 12. Therefore, since the toner T returned by the carrying member 12 is reduced, the toner T discharged to the lower light transmission window 14*a* is reduced so that the time during which the detection light L is blocked with the toner is also reduced. In other words, a time during which the toner T influences the light shield on the lower light transmission window 14*a* is also reduced in accordance with the amount of toner T remaining in the rotating region of the carrying member 12. As a result, the light transmitting time t of the detection light L gradually increases. A time at which the light transmitting time t starts to increase is the point D in FIG. 3. At the point D, when the user is going to be informed of the remaining amount of toner T, the user can be informed that the remaining amount of toner is about ¼ (about 25%). The light transmitting time at the point D is substantially equal to the light transmitting time at the point C since the toner T remains in the lower half region of the rotating region of the carrying member 12.

As described above, when the toner T is further consumed from the point D shown in FIG. 3, the toner T in the rotating region of the carrying member 12 gradually is reduced, and the detection light L gradually increases the light transmitting time t. The relationship between the remaining amount of toner T and the light transmitting time t of the detection light L becomes the region of a line segment D' between the point D and the point E in FIG. 3. As the toner T gradually decreased from the point D, because the toner T that blocks the light to the lower light transmission window 14*a* gradually is reduced, the light transmitting time t of the detection light L changes (increases) linearly. The phenomenon will be described in more detail with reference to FIG. 3. As shown in FIG. 3, as the toner T gradually is reduced in the region of the line segment D' between the point D and the point E, the light transmitting time t corresponding to the region of the line segment D' between the point D and the point E changes (increases) linearly such as $t1<t2<t3<t4$, where t1 is a light transmitting time of the detection light L when the toner T is consumed from the point D to the point D'1, t2 is a light transmitting time of the detection light L when the toner T is consumed from the point D to the point D'2, t3 is a light transmitting time of the detection light L when the toner T is consumed from the point D to the point D'3, and t4 is a light transmitting time of the detection light L when the toner T is consumed from the point D to the point E. The user can be informed of the linear toner remaining D'1 (about 20%), D'2 (about 15%), D'3 (about 12%) and so on by using a linear change of the light transmitting time.

When the toner T is further reduced in the rotating region of the carrying member 12, as shown in FIG. 6A, the carrying member 12 supplies the toner T to the supply roller 11 side after wiping off the inner surface of the lower light transmission window 14*a* by the blade 12*f*. Then, the carrying member 12 returns the remaining toner of a slight amount after supplying the toner of a short amount to the supply roller 11 side, and discharges the toner T to the lower light transmission window 14*a* side. However, because the discharged amount of toner is slight, the lower light transmission window 14*a* is not shielded from the light. Accordingly, at that time, since the blocking of the detection light L is merely periodically conducted at the blade 12*f* of the carrying member 12, the light transmitting time t of the detection light L becomes constant. The relationship between the remaining amount of toner T and the light transmitting time t of the detection light L is the point E in FIG. 3. In this case, the remaining amount of toner T within the toner container 16 (the amount of toner remaining in the rotating region of the carrying member 12 and in the region portion of the supply roller 11) is about ⅒ (about 10%). Therefore, the user can be informed that the remaining amount of toner T is about 1/10 by using a light transmission signal from the light receiving element 15*b* at that time.

The arrangement of the openings 14*a* and 14*b* will be described with reference to FIG. 2. The position of the first light transmission opening 14*a* is so arranged as to be below a horizontal plane f1 that passes through the rotating center x1 of the developer carrying member 12 and upstream of a vertical plane f2 that passes through the rotating center x1 in the developer carrying direction (a direction indicated by an arrow F in FIG. 2) of the developer carrying member 12, when the developer containing portion 16 is mounted in the electrophotographic image forming apparatus main body A1. The second light transmission opening 14*b* is so arranged as to be positioned on the top surface 16*b* of the developer containing portion 16. The openings 14*a* and 14*b* are disposed on one end side of the containing portion 16 in the longitudinal direction.

The above arrangement of the opening 14*a* and the opening 14*b* enables the light to be transmitted from a stage where the developer remains within the container (containing portion) 16. Therefore, the light transmitting time corresponding to the remaining amount of developer can be obtained. Therefore, the remaining amount of developer can be successively detected.

Also, the second developer carrying member 13 is disposed upstream in the developer carrying direction (the direction indicated by the arrow F in FIG. 2) of the developer carrying member 12 within the developer containing portion 16. A first recess portion 16*c* shaped along the rotation of the developer carrying member 12 and a second recess portion 16*d* shaped along the rotation of the second developer carrying member 13 are disposed in the inner surface of the developer containing portion 16. The position of the first light transmission opening 14*a* is located between the lowest point 16*c* 1 of the first recess portion 16*c* and the lowest point 16*d* 1 of the second recess portion 16*d* when the developer containing portion 16 is mounted in the electrophotographic image forming apparatus main body A1. This arrangement enables the remaining amount of developer to be further accurately detected. FIG. 2 shows a state where the cartridge B is mounted in the apparatus main body A1.

Subsequently, the control of the image forming apparatus main body A1 will be described with reference to FIG. 10.

The apparatus main body A1 is provided with an MPU 1000 (detecting means) which serves as an engine controller. The MPU 1000 conducts the electric control of the apparatus main body A1. Then, after a power supply of the main body turns on, the detection of various states enables the image forming operation.

Figure 10:
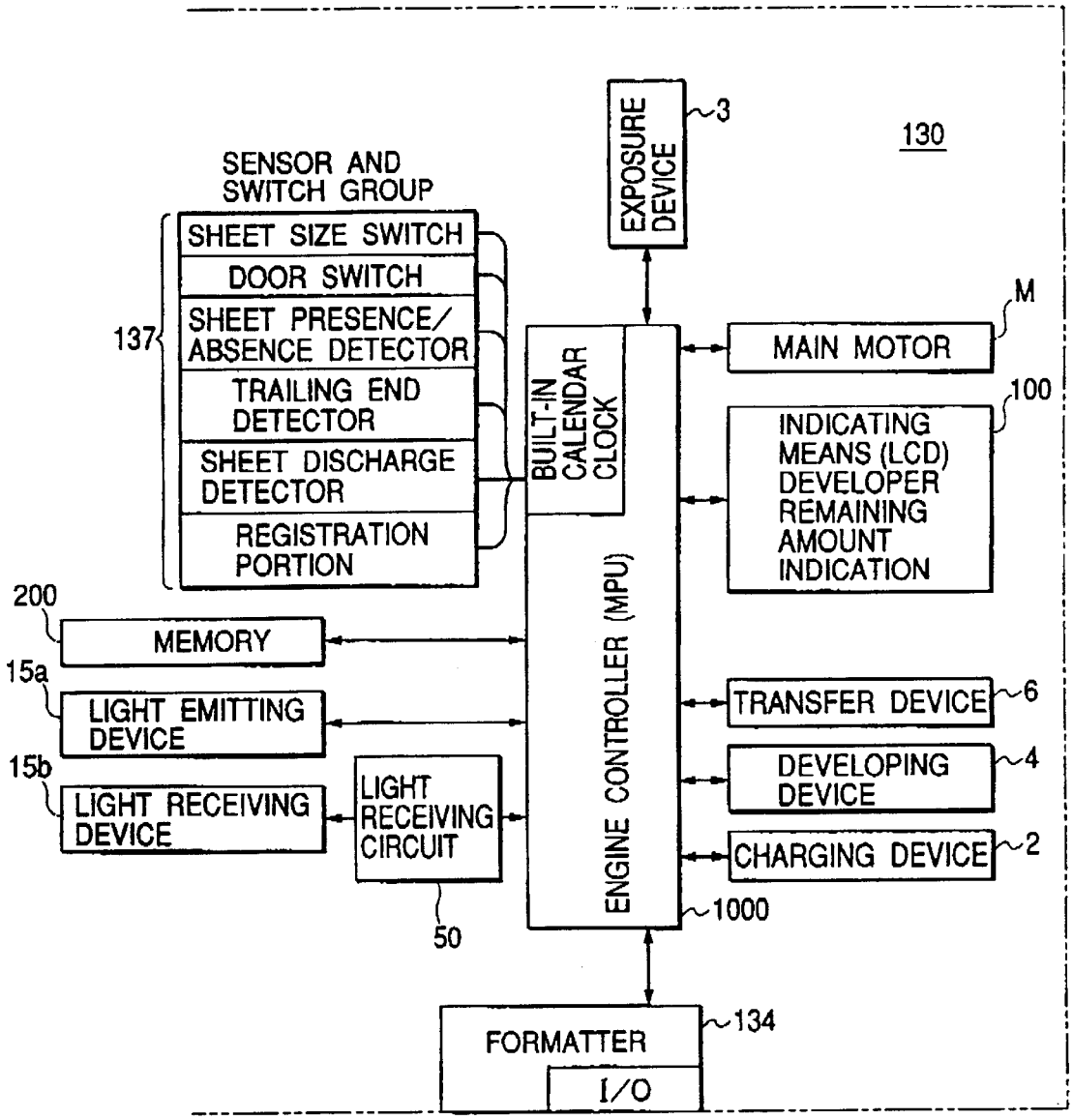
FIG. 10 is a block diagram showing an embodiment of the present invention.
Figure 11:
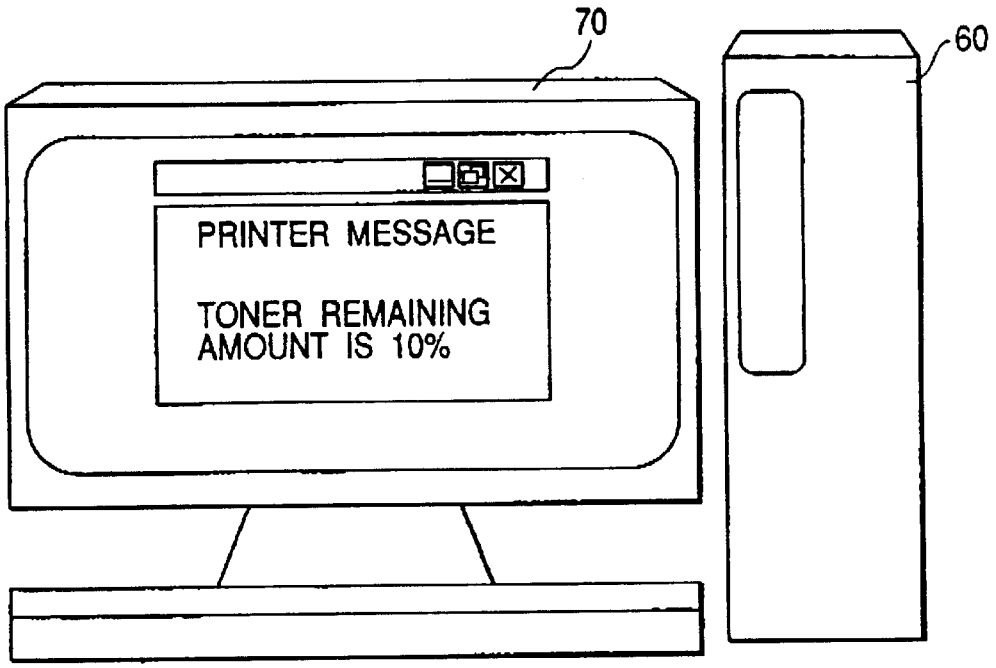
FIG. 11 is a diagram showing an example of display means.

As shown in FIG. 10, information from a sensor and a switch group 137 provided in the apparatus main body A1 is inputted to the MPU 1000. Also, the MPU 1000 controls the charging device 2, the exposure device 3, the developing device 4, the transfer device 6, a main motor M and so on. Then, the MPU 1000 allows the light emitting element 15*a* to emit a light in response to an input/output signal from an IO port. Then, the MPU 1000 calculates the remaining amount of toner on the basis of a time during which the light receiving element 15*b* receives the light. Based on the calculated amount, the remaining amount of toner within the cartridge B (within the developing device 4) is successively indicated by indicating means 100. That is, the MPU 1000 that serves as the detecting means successively detects the remaining amount of developer on the basis of a time during which the developer blocks the light to the light receiving element 15*b*. In this example, the indicating means is, for example, a display portion 100*a* disposed in the apparatus main body A1 (FIG. 1), a display screen 70 of a personal computer 60 (FIG. 11), or the like.

The display of the toner remaining amount may be performed by the indication of a gas meter gauge, a bar graph, a value indication (numerical indication), or the ratio to a full amount, that is, the remaining percentage.

Figure 12:
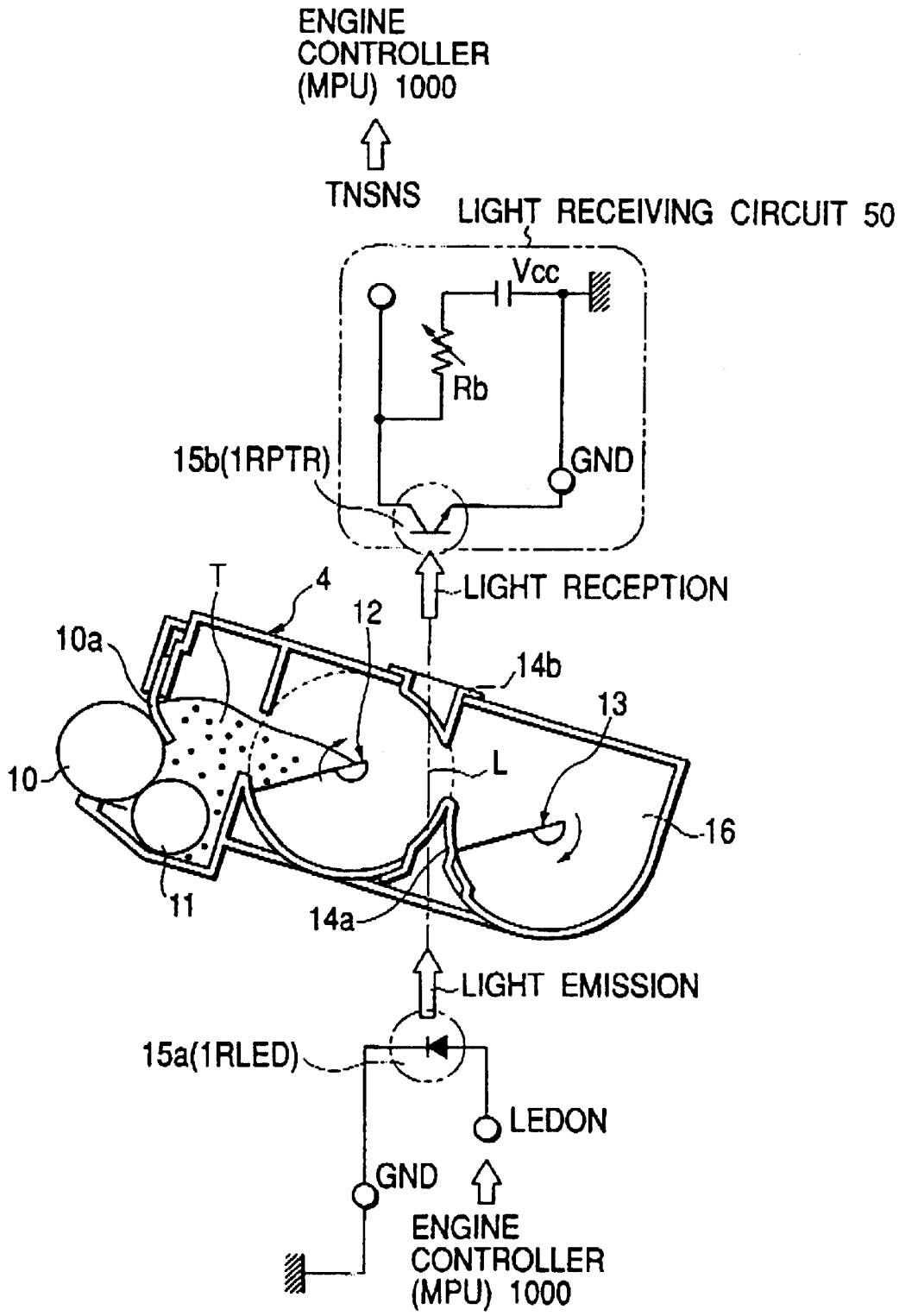
FIG. 12 is a diagram showing an electric circuit for detecting a developer remaining amount.

FIG. 12 is an example of an electric circuit for realizing the toner remaining amount detection.

In a state where there is no toner, the detection light L reaches the light receiving element 15*b*. A resistor Rb and a voltage Vcc are set according to the light receiving state of the light receiving element 15*b* in such a manner that 1 V is outputted in a state where the light is received and 5 V is outputted in a state where the light is not received. A threshold value of the engine controller (MPU) 1000 is set to about 3 V. The presence/absence of the toner can be judged by the on/off state of the IO of the engine controller (TNSNS in FIG. 12).

FIG. 4A, which is described above, is a diagram showing a state where the remaining amount of toner is large (50% or more). In this state, the toner T covers the window 14*a*. Therefore, the light emitted from the light emitting element 15*a* cannot be received by the light receiving element 15*b*. Accordingly, a signal from the light receiving element 15*b* outputs 5 V indicating that the toner exists (FIG. 4B).

FIG. 5A is a diagram showing a state where the remaining amount of toner becomes less than 50%. In this state, no toner exists in the vicinity of the window member 14*a*. For that reason, the light emitted from the light emitting element 15*a* enters the light receiving element 15*b*. Since the toner still exists, the window is exposed for a time tb (FIG. 5B).

FIG. 6A is a diagram showing a state where the remaining amount of toner hardly exists. The light receiving element outputs the voltage 1 V indicating that no toner exists to the MPU 1000 for a time tc during which the agitating blade 12*f* does not block the optical path L (FIG. 6B).

Figure 13:
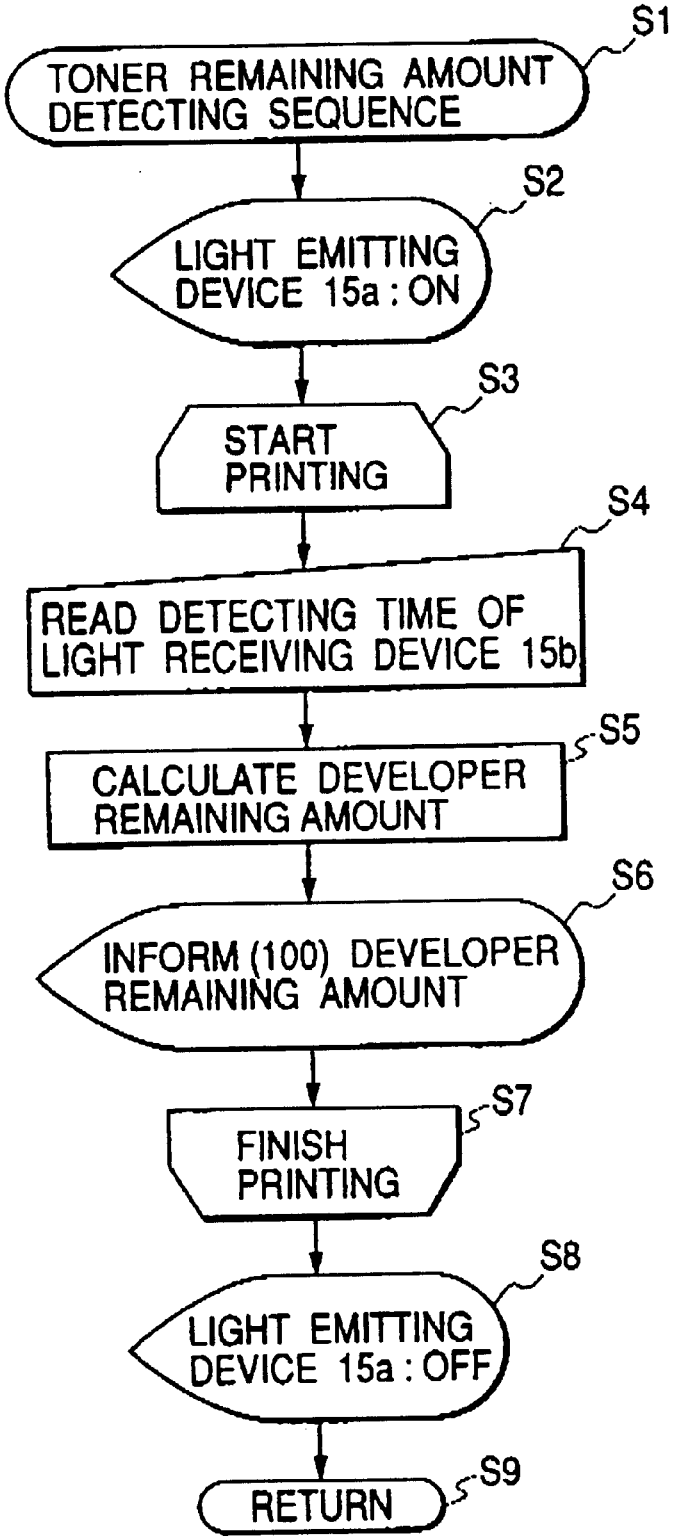
FIG. 13 is a flowchart showing a process of detecting a toner remaining amount.
Figure 14:
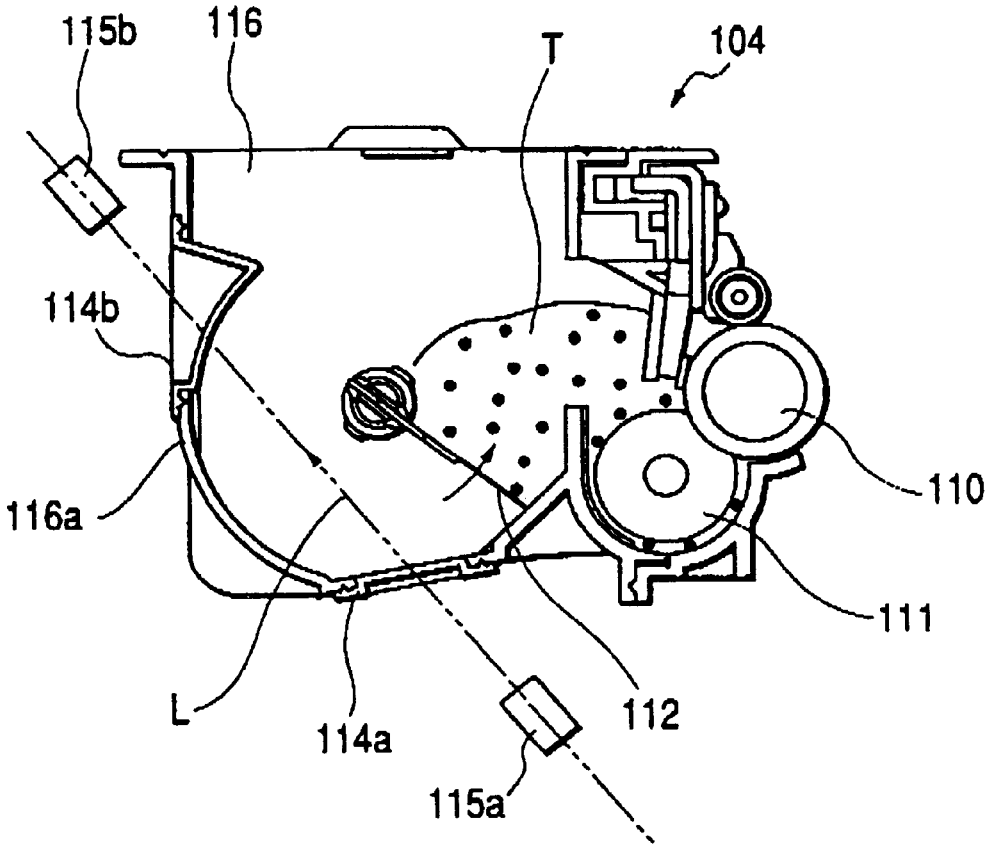
FIG. 14 PRIOR ART
FIG. 14 is a vertical cross-sectional view showing a developing device provided in a conventional process cartridge.

FIG. 13 shows an example of a sequence that realizes the toner remaining amount detection in accordance with an embodiment of the present invention The toner remaining amount successive detection is conducted in the order of the steps S1 to S9.

The following description is made assuming that a print sequence (S3 to S7) exists in the toner remaining amount detecting sequence. Conversely, the toner remaining amount detecting sequence may exist in the print sequence.

When the toner remaining amount detecting sequence (S1) is executed by the MPU 1000, the light emitting element 15*a* emits a light (S2). Thereafter, a predetermined pattern is printed on a predetermined number of sheets in accordance with a command from a formatter 134 (FIG. 10) through the printing operation (S3 to S7).

During the printing operation, the MPU 1000 notifies the user of the lifetime of the cartridge (toner remaining amount) (S6). This method is to convert a light receiving time during which the light receiving element 15*b* detects the light into a consumed amount of toner (cartridge lifetime) and to inform the user of the consumed toner amount as the cartridge lifetime.

In the above lifetime converting method, the value of the above-mentioned conversion table shown in FIG. 3 is stored in a non-volatile memory 200 (FIG. 10) disposed in the apparatus main body A1.

As described above, according to this embodiment, the developer is carried by the developer carrying member to a position in which the developer blocks the light that has entered the developer containing portion from the first light transmission opening. Then, the remaining amount of developer is successively detected on the basis of a period of time during which the developer carried by the developer carrying member blocks the light. With this structure, the remaining amount of developer can be successively detected from a stage where the developer remains in the developer containing portion.

In this embodiment, the lower light transmission window 14*a* is disposed substantially horizontally with the shaft 12*d* of the carrying member 12 in the toner container 16. As a result, the user can be informed of the remaining amount of toner in a state where the toner T sufficiently remains within the toner container 16. Also, the light transmission of the detection light L to the lower light transmission window 14*a* can occur even in a state where some amount of toner remains in the lower portion of the lower light transmission window 14*a*. As a result, the user can be notified of the fact that the toner T is being completely consumed in a state where a slight amount of toner remains within the toner container 16.

Also, the toner T is held by the plate-shaped blade 12*f* with the rotation of the carrying member 12, and the detection light L, which is transmitted through the lower light transmission window 14*a,* can be blocked in accordance with the remaining amount of toner held by the blade 12*f*. Then, the light transmission time t1 <t2 <t3 <t4, which is linear, in accordance with the remaining amount of toner can be obtained. That is, the remaining amount of toner can be successively detected on the basis of a period of time during which the remaining toner held by the carrying member 12 blocks the detection light L. Also, the user can be notified of the present remaining amount of toner by using a light transmission signal corresponding to the light transmitting time that accords to the linear remaining amount of toner. Therefore, since the user can know the present remaining amount of toner within the toner container 16, a fresh process cartridge can be prepared.

Second Embodiment

In this embodiment, the carrying member 12 is shaped in a dogleg.

Figure 7:
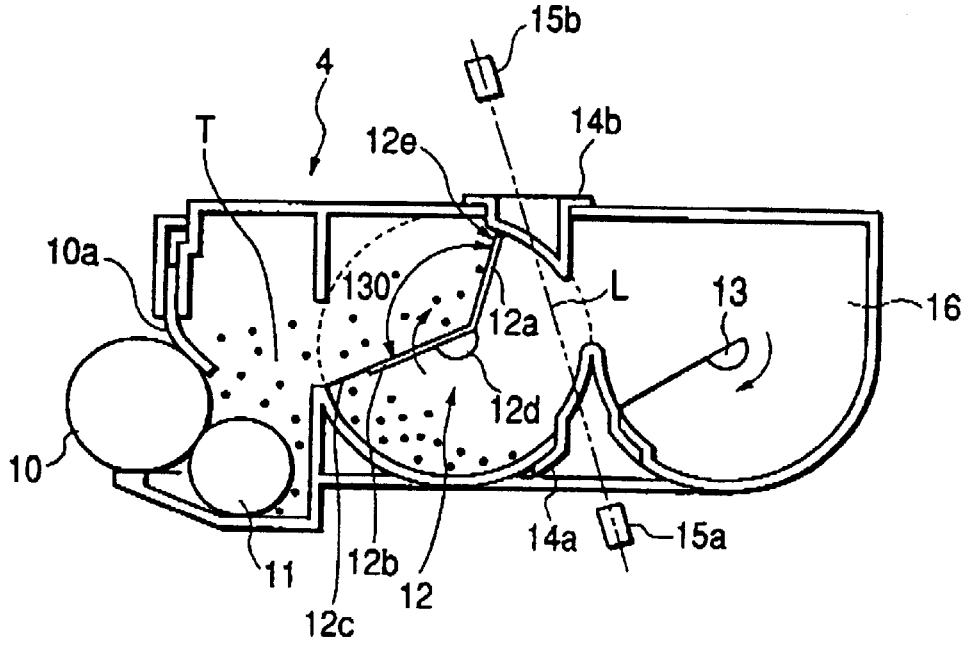
FIG. 7 is a vertical cross-sectional view showing a light-transmission-type, toner-remaining-amount detecting structure of a developing device provided in a process cartridge in accordance with a second embodiment.
Figure 8:
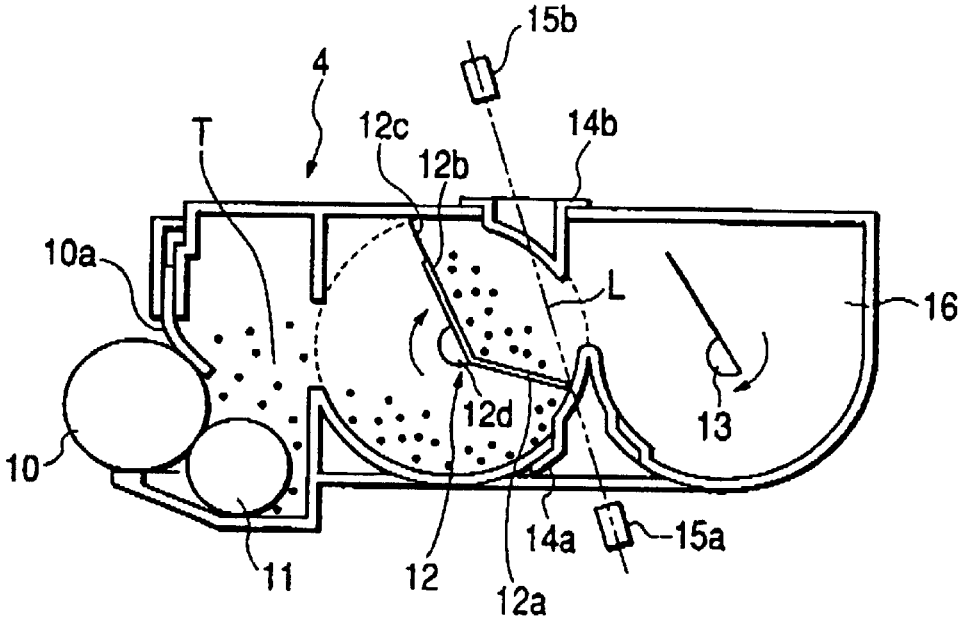
FIG. 8 is a cross-sectional view showing a developing device having a toner amount corresponding to a point D shown in FIG. 9.
Figure 9:
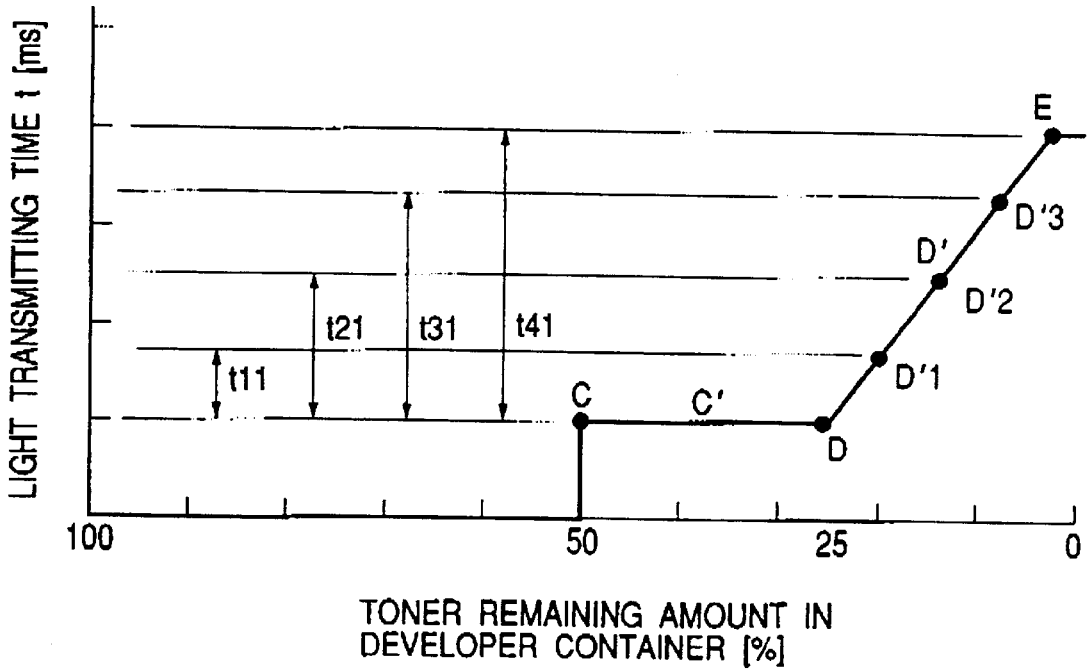
FIG. 9 is an explanatory diagram showing the toner remaining amount within a toner container and a light transmitting time.

Hereinafter, the toner remaining amount detecting method, the developing device and the process cartridge according to this embodiment will be described with reference to FIGS. 7 to 9. FIG. 7 is a vertical cross-sectional view showing a light-transmission-type, toner-remaining-amount detecting structure of a developing device provided in a process cartridge in accordance with a second embodiment, FIG. 8 is a cross-sectional view showing a developing device having a toner amount corresponding to a point D shown in FIG. 9, and FIG. 9 is an explanatory diagram showing the toner remaining amount within a toner container and a light transmitting time. In this embodiment, the common parts to those in the first embodiment are designated by the same reference signs, and their description will be omitted.

The Toner Remaining Amount Detecting Structure of Light Transmission Type

The light-transmission-type, toner-remaining-amount detecting structure of the developing device 4 having the process cartridge B in accordance with this embodiment will be described in more detail with reference to FIG. 7.

As shown in FIG. 7, the carrying member 12 has a substantially dogleg-shaped blade 12*e*. The blade 12*e* is formed in a substantially dogleg shape by bending a single metal plate into the first blade 12*a* and the second blade 12*b* so as to form an angle of about 130 degrees in the vicinity of the shaft 12*d*. A thin resin plate 12*c* made of PET is fixed to a distal end of the second blade 12*b* positioned downstream of the rotating direction of the carrying member 12 with a pressure sensitive adhesive double coated tape or an adhesive. The resin plate 12*c* is so designed as to wipe off the toner T stuck on the inner surfaces of the light transmission windows 14*a* and 14*b* without damaging the inner surfaces when the resin plate 12*c* comes in contact with the lower light transmission window 14*a* and the upper light transmission window 14*b*. Then, the second blade 12*b* is fixed to the shaft 12*d* with the pressure sensitive adhesive double coated tape or the like.

Description of the Toner Remaining Amount Detecting Method

Subsequently, the light-transmission-type, toner-remaining-amount detecting method will be described in more detail with reference to FIGS. 7 to 9. In the toner-remaining-amount detecting method according to this embodiment, since a point C, a line segment C'region, the remaining amount of toner within the toner container at a point D, and the light transmitting time corresponding to the remaining amount of toner as shown in FIG. 9 are identical with the point C, the line segment C'region, the remaining amount of toner within the toner container at the point D and the light transmitting time corresponding to the remaining amount of toner in the first embodiment shown in FIG. 3, their description will be omitted.

In the developing device 4 according to this embodiment, when the carrying member 12 is rotationally driven clockwise, the carrying member 12 holds the toner T within the toner container 16 between the blade 12*a* and the blade 12*b*. Then, after the inner surface of the lower light transmission window 14*a* is wiped off by the distal end of the resin plate 12*c,* the toner T is supplied to the region portion of the supply roller 11. The carrying member 12 returns the remaining toner T which has been supplied to the supply roller 11 side by the short amount as it is. In this situation, the toner T is held by the first blade 12*a* and the second blade 12*b* which form the substantially dogleg shape and then returned while being rotationally held by the first and second blades 12*a* and 12*b*. Then, as shown in FIG. 8, when the first blade 12*a* reaches the lower light transmission window 14*a*, the toner T slips down on the first blade 12*a* and is then discharged onto the lower light transmission window 14*a*. As a result, the toner T blocks the detection light L that is transmitted through the lower light transmission window 14*a*.

The carrying member 12 is driven to be rotated and repeats the operation of supplying the toner to the supply roller 11 side so far as the toner T remains below the lower light transmission window 14*a*. In other words, even if the amount of toner T is reduced, the first blade 12*a* and the second blade 12*b* hold the toner T remaining below the lower light transmission window 14*a* while being rotated, and the toner T slips down on the first blade 12*a*, is then discharged on the lower light transmission window 14*a*, and blocks the detection light L which is transmitted through the lower light transmission window 14*a*. The period of time during which the toner T blocks the detection light L which is transmitted through the lower light transmission window 14*a* becomes larger as the toner amount remaining below the lower light transmission window 14*a* is more as in the above-mentioned embodiment, and the toner blocks the detection light L corresponding to the toner amount remaining below the lower light transmission window 14*a*. That is, the light transmitting time t corresponding to the toner amount is obtained.

FIG. 9 shows a relationship between the light transmitting time t during which the detection light L is received by the light receiving element 15*b* per one revolution of the dogleg-shaped carrying member 12 and the toner T remaining within the toner container 16. As shown in FIG. 9, a point C, a line segment C' region, the remaining amount of toner within the toner container at a point D and the light transmitting time corresponding to the remaining amount of toner as shown in FIG. 9 are identical with the point C, the line segment C' region, the remaining amount of toner within the toner container at the point D and the light transmitting time corresponding to the remaining amount of toner in the first embodiment shown in FIG. 3. Also, in the line segment D' region between the point D and the point E, the linear light transmitting time t corresponding to all the remaining amount of toner that has remained within the rotating region of the carrying member 12 can be obtained except for the slight toner T (refer to FIG. 8) in the vicinity of the supply roller 11 side while the toner T within the rotating region of the carrying member 12 in the toner container 16 is reduced. The more details will be described. In the line segment D' region between the point D and the point E shown in FIG. 9, the light transmitting time t corresponding to the line segment D' region between the point D and the point E linearly changes (increases) such as t11<t21<t31<t41 as the toner T gradually reduces. In this example, t11 is the light transmitting time of the detection light L when the toner T is consumed from the point D to the point D'1, t21 is the light transmitting time of the detection light L when the toner T is consumed from the point D to the point D'2, t31 is the light transmitting time of the detection light L when the toner T is consumed from the point D to the point D'3 and t41 is the light transmitting time of the detection light L when the toner T is consumed from the point D to the point E. In the line segment D' region, since the blade 12*e* of the carrying member 12 is shaped in the substantially dogleg shape, substantially all of the remaining toner that has remained within the rotating region of the substantially dogleg-shaped carrying member 12 can be supplied to the supply roller 11 side as compared with the carrying member 12 shown in the first embodiment. This is apparent from the numerical value of the remaining amount of toner corresponding to the respective points D'1, D'2 and D'3 shown in FIGS. 3 and 9. As a result, the light transmitting time of the detection light L is made to correspond to a reduction of the toner T, thereby being capable of obtaining the linear light transmission signal.

Therefore, the user can be notified of the linear toner remaining amount at the respective points D'1 (about 20%), D'2 (about 14%) and D'3 (about 8%).

As described above, since the toner T in the rotating region of the carrying member 12 is further reduced, the carrying member 12 supplies the toner T to the supply roller 11 side after the carrying member 12 wipes off the inner side of the lower light is transmission window 14*a* with the resin plate 12*c*.

Then, the carrying member 12 returns the remaining toner after the short amount of toner is supplied to the supply roller 11 side, and then discharges the toner T to the lower light transmission window 14*a* side. However, because the amount of toner T is slight, the lower light transmission window 14*a* is not shielded from the light. Therefore, at this time, the periodic light shielding of the detection light L is merely conducted by the blade 12*e* of the carrying member 12. For that reason, the light transmitting time t of the detection light L becomes constant. The relationship between the remaining amount of toner T and the light transmitting time t is the point E in FIG. 9. The light transmission signal at this time can be use to inform the user of the remaining amount of toner T. In this case, the user can be informed that the remaining amount of toner T within the toner container 16 (the amount of toner that remains in the rotating region of the carrying member 12 and the region portion of the supply roller 11) is about 1/20 (about 5%).

As described above, in this embodiment, the lower light transmission window 14*a* is disposed substantially horizontally with the shaft 12*a* of the carrying member 12 in the toner container 16 as in the first embodiment. With this structure, the user can be informed of the toner remaining amount in a state where the toner T sufficiently remains within the toner container 16. Also, the transmission of the detection light L through the lower light transmission window 14*a* can be made even in a state where some amount of toner remains below the lower light transmission window 14*a*. As a result, the user can be informed that the toner T is being completely consumed in a state where some amount of toner remains within the toner container 16.

Also, the toner T is held by the substantially dogleg-shaped blade 12*e* with the rotation of the carrying member 12, and the detection light L which is transmitted through the lower light transmission window 14*a* can be blocked in accordance with the remaining amount of toner held by the blade 12*e*. In this case, since the blade 12*e* is substantially dogleg-shaped, the linear light transmitting time t11<t21<t31<t41 corresponding to all the remaining amount of toner that has remained within the toner container 16 can be obtained except for the slight toner T in the vicinity of the supply roller 11 side with respect to a reduction in the toner T within the toner container 16. That is, the remaining amount of toner can be accurately detected every time on the basis of a period of time during which the remaining toner held by the carrying member 12 blocks the detection light L. Also, the user can be notified of the present remaining amount of toner with a high accuracy by using the light transmission signal corresponding to the light transmitting time that accords to the linear remaining amount of toner. Accordingly, since the user can be informed of the present remaining amount of toner within the toner container 16, it can be easily judged when a fresh process cartridge should be prepared. That is, the user can prepare a fresh process cartridge in accordance with the lifetime of the process cartridge B which will come in accordance with its print volume.

In this embodiment, an angle defined by the first blade 12*a* and the second blade 12*b* of the carrying member 12 is about 130 degrees in the above description. However, this angle is appropriately selected from a range between about 90 degrees and about 170 degrees in accordance with the rotating radius of the carrying member 12, the position, the shape and so on of the lower light transmission window 14*a*.

In the above-described respective embodiments, the developing device has a plurality of developer carrying members. However, the same toner-remaining-amount detecting method can be applied even to a developing device having a single developer carrying member 12. In this case, although the toner capacity of the toner container is different, the light transmitting time with respect to the remaining amount of toner may be set in accordance with the capacity of the toner container. With this structure, the user is linearly notified of the remaining amount of toner within the toner container regardless of the size of the toner capacity within the toner container.

The present invention is not limited to a case where the user is notified of the developer remaining amount between full (about 100%) and about 0%. For example, the present invention includes a case where the user is notified of the developer remaining amount between about 50% and about 0%. Also, even in the case of notifying the user that the remaining amount is 0% or no developer, this is not limited to a case where the developer is completely consumed. For example, the "0%" or "No Developer" of the present invention may indicate a case in which the remaining amount of developer is consumed to the extent that it becomes difficult to obtain a predetermined image quality.

Other Embodiments

In the above-mentioned embodiments, as the developing device, the developing device as developing means disposed in the process cartridge is described. Also, the developing device according to the present invention can be suitably applied to the developing device mounted in the image forming apparatus main body, independently.

Also, the process cartridge shown in the above-described embodiments forms a monochrome image. However, the present invention can be suitably applied to the process cartridge having a plurality of developing means for forming plural colors of images (for example, a two-color image, a three-color image or a full-color image, etc.).

Also, the electrophotographic photosensitive member is not limited to the photosensitive drum but includes, for example, the following members. First, a photoconductor is used as the photosensitive member, and the photoconductor includes, for example, amorphous silicon, amorphous selenium, zinc oxide, titanium oxide, organic photoconductor (OPC), and so on. Also, the shape on which the photosensitive member is mounted is, for example, drum-shaped or belt-shaped. For example, in the drum-shaped photosensitive member, a photoconductor is deposited or coated on a cylinder made of aluminum alloy.

Also, the developing method may be known various developing methods such as a two-component magnetic brush development method, a cascade development method, a touchdown development method or a cloud development method.

Further, the structure of the charging means uses a so-called contact charging method in the above-mentioned embodiments. As another structure, there may be used a structure in which a metal shield such as aluminum is coated on a three-directional surroundings of a tungsten wire used up to now, and positive or negative ions produced by applying a high voltage to the tungsten wire are moved to the surface of the photosensitive drum, and the surface of the drum is uniformly charged.

The charging means may be of a blade type (charge blade), a pad type, a block type, a rod type, a wire type or the like other than the above roller type.

Further, as the method of cleaning the toner remaining in the photosensitive drum, the cleaning means may be structured by using a blade, a fur brush or a magnetic brush.

Further, the above-mentioned process cartridge includes, for example, the electrophotographic photosensitive member and the process means. Therefore, the modes of the process cartridge are, for example, that the electrophotographic photosensitive member, the developing means and the charging means are integrated together into a cartridge, and the cartridge is detachably mountable on the apparatus main body, that the electrophotographic photosensitive drum, the developing means and the cleaning means are integrated together into a cartridge, and the cartridge is detachably mountable on the apparatus main body, and that at least two members including the electrophotographic photosensitive member and the process means are combined and integrated together into a cartridge, and the cartridge is detachably mountable on the apparatus main body, other than the above-mentioned embodiments.

In other words, the above-mentioned process cartridge is that the charging means or the cleaning means is integrated with the electrophotographic photosensitive member and the developing means into a cartridge, and the cartridge is detachably mountable on the image forming apparatus main body, that at least one of the charging means and the cleaning means is integrated with the electrophotographic photosensitive drum and the developing means into a cartridge, and the cartridge is detachably mountable on the image forming apparatus main body, and that at least the developing means and the electrophotographic photosensitive member are integrated together into a cartridge, and the cartridge is detachably mountable on the image forming apparatus main body. Then, the process cartridge can be detachably mounted on the apparatus main body by the user per se. Therefore, the maintenance of the apparatus main body can be conducted by the user per se.

In addition, in the above-mentioned embodiments, the laser beam printer is exemplified as the electrophotographic image forming apparatus, but the present invention is not limited to this. For example, the present invention can be applied to an electrophotographic image forming apparatus such as an electrophotographic copying machine, a facsimile machine or a word processor.

As was described above, according to the present invention, the remaining amount of developer can be detected from a state where the developer remains in the developer containing portion.

While the invention has been described with reference to the structure disclosed therein, it is not confined to the details set forth and this application is intended to cover such modifications or changes as may come within the purposes of the improvements or the scope of the following claims.

What is claimed is:

1. A method of detecting a developer remaining amount for successively detecting the remaining amount of a developer used for developing an electrostatic latent image formed on an electrophotographic photosensitive member, said method comprising:

successively detecting the remaining amount of developer based on a period of time for which light is blocked by a developer carried by a developer carrying member, wherein the developer is carried by the developer carrying member to a position in which the developer blocks the light that has entered a developer containing portion from a first light transmission opening of said developer containing portion for containing the developer when the light transmitted from the first light transmission opening to the inside of the developer containing portion is transmitted from a second light transmission opening of the developer containing portion to the outside of the developer containing portion, wherein said first light transmission opening protrudes above a lower plane of said developer containing portion when said developer containing portion is mounted in an electrophotographic image forming apparatus main body, and said first light transmission opening is downwardly inclined along a rotating direction of said developer carrying member, and wherein said second light transmission opening is located above said first light transmission opening when said developer containing portion is mounted in the electrophotographic image forming apparatus main body.

2. A method of detecting a developer remaining amount according to claim 1, wherein said developer carrying member has a plate-shaped carrying blade, and said developer is held and carried by said carrying blade to the position in which the developer blocks the light entering said developer containing portion from said first light transmission opening.

3. A method of detecting a developer remaining amount according to claim 1, wherein said developer carrying member has a substantially dogleg-shaped carrying blade, and said developer is held and carried by said carrying blade to the position in which the developer blocks the light entering said developer containing portion from said first light transmission opening.

4. A method of detecting a developer remaining amount according to claim 3, wherein said carrying blade is substantially dogleg-shaped at a bend angle in a range from about 90° to about 170°.

5. A method of detecting a developer remaining amount according to any one of claims 1 to 4, wherein said first light transmission opening is disposed below a horizontal plane that passes through a rotating center of said developer carrying member and upstream of a vertical plane that passes through the rotating center in a developer carrying direction of said developer carrying member when said developer containing portion is mounted in the electrophotographic image forming apparatus main body, and said second light transmission opening is disposed on a top surface of said developer containing portion.

6. A method of detecting a developer remaining amount according to any one of claims 1 to 4, wherein a second developer carrying member is disposed upstream of said developer carrying member in a developer carrying direction within said developer containing portion, a first recess portion shaped along a rotation of said developer carrying member and a second recess portion shaped along a rotation of said second developer carrying member are disposed in an inner surface of said developer containing portion, and said first light transmission opening is disposed between a lowest point of said first recess portion and a lowest point of said second recess portion when said developer containing portion is mounted in the electrophotographic image forming apparatus main body.

7. A developing device for developing an electrostatic latent image formed on an electrophotographic photosensitive member, said developing device comprising:

a developing member for developing the electrostatic latent image formed on said electrophotographic photosensitive member;

a developer containing portion for containing a developer used for developing the electrostatic latent image by said developing member;

a first light transmission opening formed in said developer containing portion for allowing a light to be transmitted from an outside of said developer containing portion to an inside of said developer containing portion;

a second light transmission opening formed in said developer containing portion for allowing the light transmitted from said first light transmission opening into the inside of said developer containing portion to be transmitted to the outside of said developer containing portion; and a developer carrying member for carrying the developer to a position in which the developer blocks the light transmitted from said first light transmission opening into said developer containing portion, wherein a remaining amount of developer is successively detected based on a period of time for which the developer carried by said developer carrying member blocks the light, wherein said first light transmission opening protrudes above a lower plane of said developer containing portion when said developing device is mounted in an electrophotographic image forming apparatus main body, and said first light transmission opening is downwardly inclined along a rotating direction of developer carrying member, and wherein said second light transmission opening is located above said first light transmission opening when said developing device is mounted in the electrophotographic image forming apparatus main body.

8. A developing device according to claim 7, wherein said developer carrying member has a plate-shaped carrying blade for holding and carrying said developer.

9. A developing device according to claim 7, wherein said developer carrying member has a substantially dogleg-shaped carrying blade for holding and carrying said developer.

10. A developing device according to claim 9, wherein said carrying blade is substantially dogleg-shaped at a bend angle in a range from about 90° to about 17°.

11. A developing device according to any one of claims 7 to 10, wherein said first light transmission opening is disposed below a horizontal plane that passes through a rotating center of said developer carrying member and upstream of a vertical plane that passes through the rotating center in a developer carrying direction of said developer carrying member, when said developing device is mounted in the electrophotographic image forming apparatus main body, and said second light transmission opening is disposed on a top surface of said developer containing portion.

12. A developing device according to any one of claims 7 to 10, wherein a second developer carrying member is disposed upstream of said developer carrying member in a developer carrying direction within said developer containing portion, a first recess portion shaped along a rotation of said developer carrying member and a second recess portion shaped along a rotation of said second developer carrying member are disposed in an inner surface of said developer containing portion, and said first light transmission opening is disposed between a lowest point of said first recess portion and a lowest point of said second recess portion when said developing device is mounted in the electrophotographic image forming apparatus main body.

13. A process cartridge detachably mountable on an electrophotographic image forming apparatus main body, said process cartridge comprising:

a) an electrophotographic photosensitive member; and b) developing means for developing an electrostatic latent image formed on said electrophotographic photosensitive member, said developing means comprising:

a developing member for developing the electrostatic latent image formed on said electrophotographic photosensitive member;

a developer containing portion for containing a developer used for developing the electrostatic latent image by said developing member;

a first light transmission opening formed in said developer containing portion for allowing a light to be transmitted from an outside of said developer containing portion to an inside of said developer containing portion;

a second light transmission opening formed in said developer containing portion for allowing the light transmitted from said first light transmission opening into the inside of said developer containing portion to be transmitted to the outside of said developer containing portion; and a developer carrying member for carrying the developer to a position in which the developer blocks the light transmitted from said first light transmission opening into said developer containing portion, wherein a remaining amount of developer is successively detected based on a period of time for which the developer carried by said developer carrying member blocks the light, wherein said first light transmission opening protrudes above a lower plane of said developer containing portion when said process cartridge is mounted in an electrophotographic image forming apparatus main body, and said first light transmission opening is downwardly inclined along a rotating direction of developer carrying member, and wherein said second light transmission opening is located above said first light transmission opening when said process cartridge is mounted in the electrophotographic image forming apparatus main body.

14. A process cartridge according to claim 13, wherein said first light transmission opening is disposed above a rotating center of said developer carrying member, and said second light transmission opening is disposed horizontal to the rotating center when said process cartridge is mounted on the electrophotographic image forming apparatus main body.

15. A process cartridge according to claim 13, wherein said developer carrying member provided in said developing means has a plate-shaped carrying blade for holding and carrying said developer.

16. A process cartridge according to claim 13, wherein said developer carrying member provided in said developing means has a substantially dogleg-shaped carrying blade for holding and carrying said developer.

17. A process cartridge according to claim 16, wherein said carrying blade is substantially dogleg-shaped at a bend angle in a range from about 90° to about 170°.

18. A process cartridge according to any one of claims 13 to 17, wherein said first light transmission opening is disposed below a horizontal plane that passes through a rotating center of said developer carrying member and upstream of a vertical plane that passes through the rotating center in a developer carrying direction of said developer carrying member when said process cartridge is mounted in the electrophotographic image forming apparatus main body, and said second light transmission opening is disposed on a top surface of said developer containing portion.

19. A process cartridge according to any one of claims 13 to 17, wherein a second developer carrying member is disposed upstream of said developer carrying member in a developer carrying direction within said developer containing portion, a first recess portion shaped along a rotation of said developer carrying member and a second recess portion shaped along a rotation of said second developer carrying member are disposed in an inner surface of said developer containing portion, and said first light transmission opening is disposed between a lowest point of said first recess portion and a lowest point of said second recess portion when said process cartridge is mounted in said electrophotographic image forming apparatus main body.

20. A process cartridge according to any one of claims 13 to 17, wherein said process cartridge is such that at least one of charging means for charging said electrophotographic photosensitive member and cleaning means for removing the developer remaining on said electrophotographic photosensitive member are integrated with said developing means and said electrophotographic photosensitive member into a cartridge, and said cartridge is detachably mountable on said electrophotographic image forming apparatus main body.

21. An electrophotographic image forming apparatus for forming an image on a recording medium, said apparatus comprising:

a) an electrophotographic photosensitive member;

b) a developing device including:

a developing member for developing an electrostatic latent image formed on said electrophotographic photosensitive member;

a developer containing portion for containing a developer used for developing the electrostatic latent image by said developing member;

a first light transmission opening formed in said developer containing portion for allowing a light to be transmitted from an outside of said developer containing portion to an inside of said developer containing portion;

a second light transmission opening formed in said developer containing portion for allowing the light transmitted from said first light transmission opening into the inside of said developer containing portion to be transmitted to the outside of said developer containing portion; and a developer carrying member for carrying the developer to a position in which the developer blocks the light transmitted from said first light transmission opening into said developer containing portion, wherein said first light transmission opening protrudes above a lower plane of said developer containing portion of said developing device provided in an electrophotographic image forming apparatus main body, and said first light transmission opening is downwardly inclined along a rotating direction of said developer carrying member, and wherein said second light transmission opening is located above said first light transmission opening; and c) detecting means for successively detecting a remaining amount of developer based on a period of time for which the developer carried by said developer carrying member blocks the light.

22. An electrophotographic image forming apparatus to which a process cartridge is detachably mountable for forming an image on a recording medium, said apparatus comprising:

a) an electrophotographic photosensitive member;

b) a mounting portion detachably mounting a process cartridge having developing means for developing an electrostatic latent image formed on said electrophotographic photosensitive member, said developing means including:

a developing member for developing the electrostatic latent image formed on said electrophotographic photosensitive member;

a developer containing portion for containing a developer used for developing the electrostatic latent image by said developing member;

a first light transmission opening formed in said developer containing portion for allowing a light to be transmitted from an outside of said developer containing portion to an inside of said developer containing portion;

a second light transmission opening formed in said developer containing portion for allowing the light transmitted from said first light transmission opening into the inside of said developer containing portion to be transmitted to the outside of said developer containing portion; and a developer carrying member for carrying the developer to a position in which the developer blocks the light transmitted from said first light transmission opening into said developer containing portion, wherein said first light transmission opening protrudes above a lower plane of said developer containing portion when said process cartridge is mounted in an electrophotographic image forming apparatus main body, and said first light transmission opening is downwardly inclined along a rotating direction of said developer carrying member, and wherein said second light transmission opening is located above said first light transmission opening when said process cartridge is mounted in the electrophotographic image forming apparatus main body; and c) detecting means for successively detecting a remaining amount of developer based on a period of time for which the developer carried by said developer carrying member blocks the light.

23. A electrophotographic image forming apparatus according to claim 21 or 22, further comprising an indicating portion for indicating the remaining amount of developer detected by said detecting means.

24. A electrophotographic image forming apparatus according to claim 21 or 22, wherein the remaining amount of developer detected by said detecting means is displayed on a display screen connected to a computer.

25. A method of detecting a developer remaining amount for successively detecting the remaining amount of a developer used for developing an electrostatic latent image formed on an electrophotographic photosensitive member, said method comprising:

successively detecting the remaining amount of developer based on a period of time for which light is blocked by a developer carried by a first developer carrying member, wherein the developer is carried by the first developer carrying member to a position in which the developer blocks the light that has entered a developer containing portion from a first light transmission opening of said developer containing portion for containing the developer when the light transmitted from the first light transmission opening to the inside of the developer containing portion is transmitted from a second light transmission opening of the developer containing portion to the outside of the developer containing portion, wherein a second developer carrying member is disposed upstream of said first developer carrying member in a developer carrying direction within said developer containing portion, wherein a first recess portion shaped along a rotation of said first developer carrying member and a second recess portion shaped along a rotation of said second developer carrying member are disposed in an inner surface of said developer containing portion, and said first light transmission opening is disposed between a lowest point of said first recess portion and a lowest point of said second recess portion when said developer containing portion is mounted in an electrophotographic image forming apparatus main body.

26. A method of detecting a developer remaining amount according to claim 25, wherein said first developer carrying member has a plate-shaped carrying blade, and said developer is held and carried by said carrying blade to the position in which the developer blocks the light entering said developer containing portion from said first light transmission opening.

27. A method of detecting a developer remaining amount according to claim 25, wherein said first developer carrying member has a substantially dogleg-shaped carrying blade, and said developer is held and carried by said carrying blade to the position in which the developer blocks the light entering said developer containing portion from said first light transmission opening.

28. A method of detecting a developer remaining amount according to claim 27, wherein said carrying blade is substantially dogleg-shaped at a bend angle in a range from about 90° to about 170°.

29. A method of detecting a developer remaining amount according to any one of claims 25 to 28, wherein said first light transmission opening is disposed below a horizontal plane that passes through a rotating center of said first developer carrying member and upstream of a vertical plane that passes through the rotating center in the developer carrying direction of said first developer carrying member when said developer containing portion is mounted in the electrophotographic image forming apparatus main body, and said second light transmission opening is disposed on a top surface of said developer containing portion.

30. A developing device for developing an electrostatic latent image formed on an electrophotographic photosensitive member, said developing device comprising:

a developing member for developing the electrostatic latent image formed on said electrophotographic photosensitive member;

a developer containing portion for containing a developer used for developing the electrostatic latent image by said developing member;

a first light transmission opening formed in said developer containing portion for allowing light to be transmitted from the outside of said developer containing portion to the inside of said developer containing portion;

a second light transmission opening formed in said developer containing portion for allowing the light transmitted from said first light transmission opening into the inside of said developer containing portion to be transmitted to the outside of said developer containing portion;

a first developer carrying member for carrying the developer to a position in which the developer blocks the light transmitted from said first light transmission opening into said developer containing portion, wherein a remaining amount of developer is successively detected based on a period of time for which the developer carried by said first developer carrying member blocks the light; and a second developer carrying member disposed upstream of said first developer carrying member in a developer carrying direction within said developer containing portion, wherein a first recess portion shaped along a rotation of said first developer carrying member and a second recess portion shaped along a rotation of said second developer carrying member are disposed in an inner surface of said developer containing portion, and said first light transmission opening is disposed between a lowest point of said first recess portion and a lowest point of said second recess portion when said developing device is mounted in an electrophotographic image forming apparatus main body.

31. A developing device according to claim 30, wherein said first developer carrying member has a plate-shaped carrying blade for holding and carrying said developer.

32. A developing device according to claim 30, wherein said first developer carrying member has a substantially dogleg-shaped carrying blade for holding and carrying said developer.

33. A method of detecting a developer remaining amount according to claim 32, wherein said carrying blade is substantially dogleg-shaped at a bend angle in a range from about 90° to about 170°.

34. A developing device according to any one of claims 30 to 33, wherein said first light transmission opening is disposed below a horizontal plane that passes through a rotating center of said first developer carrying member and upstream of a vertical plane that passes through the rotating center in a developer carrying direction of said first developer carrying member, when said developing device is mounted in the electrophotographic image forming apparatus main body, and said second light transmission opening is disposed on a top surface of said developer containing portion.

35. A process cartridge detachably mountable to an electrophotographic image forming apparatus main body, said process cartridge comprising:

a) an electrophotographic photosensitive member; and b) developing means for developing an electrostatic latent image formed on said electrophotographic photosensitive member, said developing means comprising:

a developing member for developing the electrostatic latent image formed on said electrophotographic photosensitive member;

a developer containing portion for containing a developer used for developing the electrostatic latent image by said developing member;

a first light transmission opening formed in said developer containing portion for allowing light to be transmitted from the outside of said developer containing portion to the inside of said developer containing portion;

a first developer carrying member for carrying the developer to a position in which the developer blocks the light transmitted from said first light transmission opening into said developer containing portion, wherein a remaining amount of developer is successively detected based on a period of time for which the developer is carried by said first developer carrying member blocks the light; and a second developer carrying member disposed upstream of said first developer carrying member in a developer carrying direction within said developer containing portion, wherein a first recess portion shaped along a rotation of said first developer carrying member are disposed in an inner surface of said developer containing portion, and said first light transmission opening is disposed between a lowest point of said first recess portion and a lowest point of said second recess portion when said process cartridge is mounted in the electrophotographic image forming apparatus main body.

36. A process cartridge according to claim 35, wherein said first light transmission opening is disposed above a rotating center of said first developer carrying member, and said second light transmission opening is disposed horizontal to the rotating center when said process cartridge is mounted in the electrophotographic image forming apparatus main body.

37. A process cartridge according to claim 35, wherein said first developer carrying member provided in said developing means has a plate-shaped carrying blade for holding and carrying said developer.

38. A process cartridge according to claim 35, wherein said first developer carrying member provided in said developing means has a substantially dogleg-shaped carrying blade for holding and carrying said developer.

39. A method of detecting a developer remaining amount according to claim 38, wherein said carrying blade is substantially dogleg-shaped at a bend angle in a range from about 90° to about 170°.

40. A process cartridge according to any one of claims 35 to 39, wherein aid first light transmission opening is disposed below a horizontal plane that passes through a rotating center of said first developer carrying member and upstream of a vertical plane that passes through the rotating center in a developer carrying direction of said first developer carrying member when said process cartridge is mounted in the electrophotographic image forming apparatus main body, and said second light transmission opening is disposed on a top surface of said developer containing portion.

41. A process cartridge according to any one of claims 35 to 39, wherein said process cartridge is such that at least one of charging means for charging said electrophotographic photosensitive member and cleaning means for removing the developer remaining on said electrophotographic photosensitive member are integrated with said developing means and said electrophotographic photosensitive member into a cartridge, and said cartridge is detachably mountable to the electrophotographic image forming apparatus main body.

* * * * *

UNITED STATES PATENT AND TRADEMARK OFFICE

CERTIFICATE OF CORRECTION

PATENT NO. : 6,505,007 B2
DATED : January 7, 2003
INVENTOR(S) : Koji Miura et al.

It is certified that error appears in the above-identified patent and that said Letters Patent is hereby corrected as shown below:

Column 10,
Line 66, “1/1” should read -- 1/10 --.

Column 14,
Lines 22 and 26, “C´region,” should read -- C´ region, --.

Column 16,
Line 6, “use” should read -- used --.

Signed and Sealed this

Thirtieth Day of December, 2003

JAMES E. ROGAN
*Director of the United States Patent and Trademark Office*